United States Patent [19]

McGinley

[11] 4,425,946

[45] Jan. 17, 1984

[54] WEAVING METHOD AND APPARATUS

[75] Inventor: Thomas F. McGinley, Phillipsburg, N.J.

[73] Assignee: McGinley Mills, Inc., Phillipsburg, N.J. ; a part interest

[21] Appl. No.: 197,523

[22] Filed: Oct. 16, 1980

[51] Int. Cl.[3] ..... D03D 47/00

[52] U.S. Cl. ..... 139/11; 139/28

[58] Field of Search ..... 139/11 R, 11 A, 28, 139/435, 436

[56] References Cited

U.S. PATENT DOCUMENTS

| | | | |
|---|---|---|---|
| 3,828,828 | 8/1974 | Cernocky et al. | 139/435 |
| 4,122,871 | 10/1978 | McGinley | 139/11 A |
| 4,122,872 | 10/1978 | McGinley | 139/11 A |
| 4,285,370 | 8/1981 | McGinley | 139/11 A |
| 4,291,729 | 9/1981 | Steiner | 139/28 |

FOREIGN PATENT DOCUMENTS

| | | | |
|---|---|---|---|
| 1449084 | 7/1966 | France | 139/435 |
| 409812 | 10/1966 | Switzerland | 139/435 |

*Primary Examiner*—Henry Jaudon

*Attorney, Agent, or Firm*—Lerner, David, Littenberg, Krumholz & Mentlik

[57] ABSTRACT

Disclosed herein are apparatus and method of multi-shed weaving wherein a weft thread is inserted into a retained shed by a fluid jet. The movement of the fluid jet can be synchronized with the movement of the retained shed. The shed may be retained by a shed-retaining member or members adapted to removably receive one of the weft threads. A device is also disclosed for spreading apart the wrap threads to facilitate the insertion of the shed-retaining members into an open shed prior to its retention.

63 Claims, 49 Drawing Figures

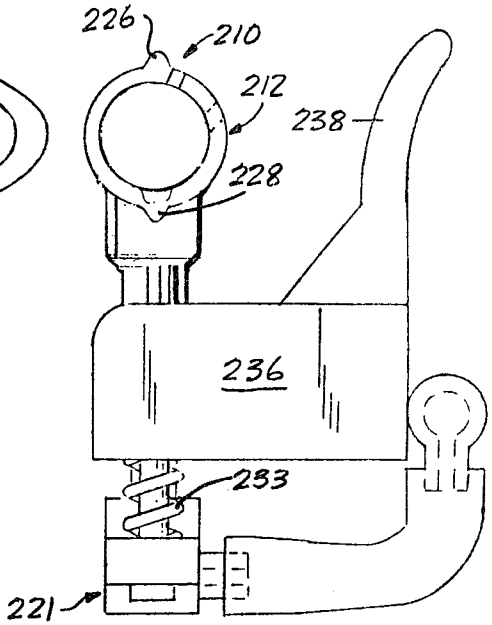
FIG. 33
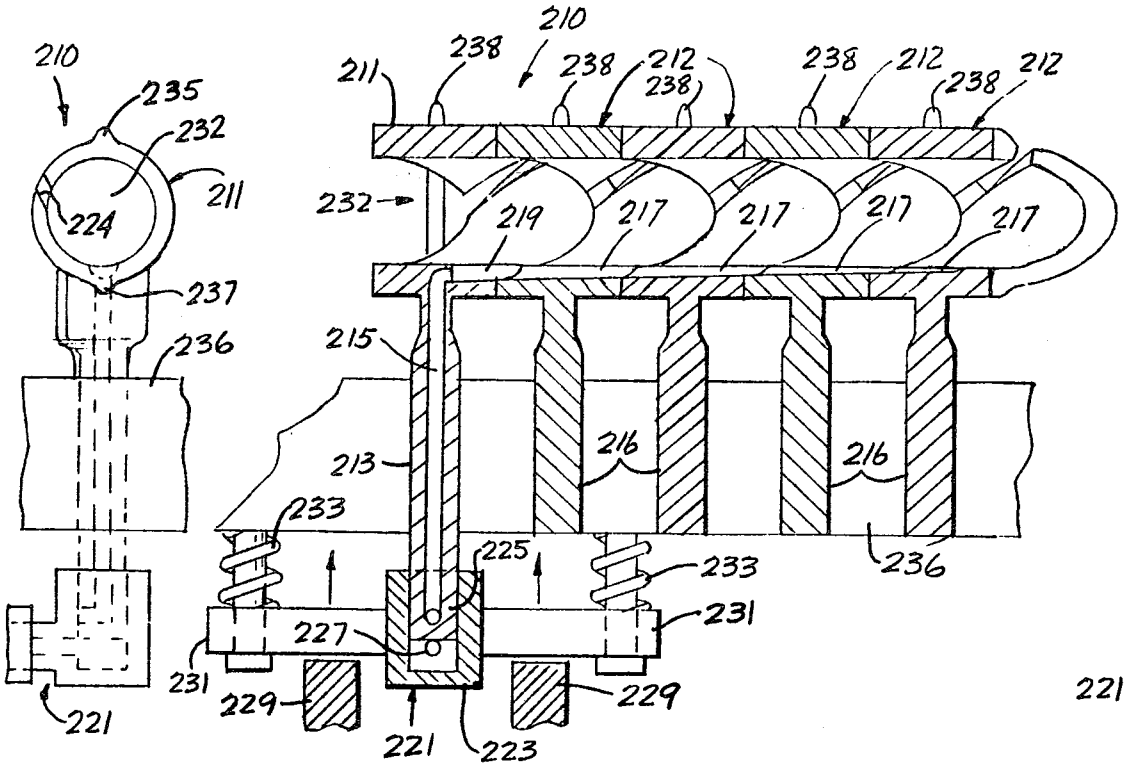
FIG. 31
FIG. 32

WEAVING METHOD AND APPARATUS

FIELD OF THE INVENTION

The present invention relates to a method and apparatus of weaving, and, more particularly, to such method and apparatus which are especially adapted for use in connection with multi-shed warp-wave weaving systems.

BACKGROUND OF THE INVENTION

Until recently, there were only two basic types of multi-shed weaving systems. These systems are (1) flat weft-wave systems, i.e., those in which a multiplicity of sheds move in the weft direction along a flat path, and (2) curved warp-wave or rotor systems, i.e., those in which a multiplicity of sheds move in the warp direction along a curved path. These weaving systems suffer from several disadvantages, one of the most critical disadvantages being the severe limitation in the diversification of weaves available due to the inability to use standard shed-forming mechanisms.

In the applicant's U.S. Pat. No. 4,122,871, there is disclosed a third type of multi-shed weaving which overcomes many of the disadvantages of the flat weft-wave systems and the curved warp-wave systems. This new and improved multi-shed weaving technique involves the use of flat warp-wave systems, i.e., those in which a multiplicity of sheds move in the warp direction along a flat path.

Along with the development of curved warp-wave weaving systems, the prior art has also developed apparatus for inserting weft threads into a plurality of warp sheds as they move in a direction parallel to the warp threads. For example, such prior art systems are disclosed in Gentilini U.S. Pat. No. 2,742,058, and British Pat. No. 819,974. However, all of these prior art systems, and those similar to them, utilize needles, rapiers, or like members, of either the flexible or rigid type, which members remain attached or connected to the weaving machine during their traversal through the moving warp sheds to lay the weft thread. Therefore, it is necessary in such systems to retract the weft-laying member to the side of the machine from which the weft thread is supplied. Such an arrangement has the disadvantage of using one-half of the time interval that the weft-laying member is within the warp shed for the non-productive motion of withdrawal or retraction of the weft-laying member from the shed after laying of the weft thread.

This drawback was recognized in the applicant's U.S. Pat. No. 4,122,871, which discloses method and apparatus for employing shuttles for simultaneously laying weft threads in a plurality of moving warp sheds. More particularly, U.S. Pat. No. 4,122,871 discloses the use of shuttles for simultaneously laying more than one weft thread in a warp-wave weaving system, wherein the shuttles are fired from at least one side of the machine, through the moving warp sheds, and are stopped on the other side of the machine. The shuttles are unconnected to the machine during their traversal of the moving warp sheds, and it is therefore unnecessary to retract the shuttles through the moving sheds. In this manner, the shuttles operate to lay weft threads in the moving sheds of a warp-wave weaving system during the entire time that the shuttles traverse the moving sheds.

In the applicant's U.S. Pat. No. 4,122,872 there is disclosed an improved weft-laying system for warp-wave weaving systems, wherein the weft threads are accurately and continuously guided to move in a lateral direction in unison with the laterally moving warp sheds during the transversal of gripper shuttles through the warp sheds. More particularly, the gripper shuttles are fired into moving warpsheds which move in a direction perpendicular to the direction in which the gripper shuttles are initially fired.

Single-phase weaving systems have been developed wherein weft threads are inserted into an open shed by a fluid jet, such as a jet of water or air, which in the case of air is directed through a weft-guiding channel removably positioned within the open shed (see, for example, U.S. Pat. Nos. 3,818,952; 3,821,972; 3,847,187; 4,116,243 and 4,125,133). The weft-guiding channel is necessary so as to partially confine the jet of fluid within the open shed, thereby maintaining the speed of the jet at a velocity required for picking the weft thread while inhibiting the jet from interfering with warp threads forming the open shed.

There are several advantages and benefits derived from the use of fluid jets in connection with the insertion of weft threads. For instance, fluid jets result in faster weft insertion. Also, fluid jets are relatively easy and inexpensive to manufacture and maintain. However, these improvements have been realized at the cost of additional energy requirements resulting from the large amount of air required due to the partial confinement of the air jet within the weft-guiding channel. Also, the partially open weft-guiding channels create the possibility that the weft thread may inadvertently escape from the weft-guiding channels, resulting in a reduction in quality and productivity.

Attempts have been made to provide substantially closed weft-guiding channels (see, for instance, U.S. Pat. No. 3,828,828 and U.S. Pat. No. 3,796,236). These attempts suffer, however, from the disadvantage of requiring additional time to close the channel, thereby decreasing the time available for weft insertion. Because of this reduced time for weft insertion, additional energy is required to successfully insert the weft thread in the shorter time available for weft insertion, thereby offsetting the energy savings gained by the use of the substantially closed weft-guiding channels. To date, no one has taught how fluid jets could be employed in a multi-phase weaving system.

SUMMARY OF THE INVENTION

Many of the disadvantages and shortcomings discussed above are overcome by the new and improved weaving method and apparatus of the present invention in which sheds of warp threads are (i) successively formed at a first location, (ii) continuously moved away from the first location and toward a second location such that they move in a direction generally parallel to the warp threads, (iii) retained during their continuous movement from the first location to the second location and (iv) provided with weft threads, each weft thread being inserted into a corresponding retained shed during its continuous movement from the first location toward the second location. In accordance with the improvement, a weft thread is inserted into a retained shed by a fluid jet.

If a predetermined number of sheds are being retained, a corresponding number of fluid jets may be employed, each fluid jet inserting a corresponding weft thread into a respective retained shed. The movement of the fluid jets is synchronized with the movement of the retained sheds such that each fluid jet moves conjointly with a corresponding one of the retained sheds during the insertion of a respective weft thread thereinto, whereby a predetermined number of weft threads can be inserted substantially simultaneously into a corresponding number of the retained sheds. To ensure complete insertion of the weft threads, each fluid jet is sustained for the time required to insure complete insertion of a corresponding weft thread.

It is noted here that in the illustrated preferred embodiments, there are six shed retainers and four fluid jets and that there is no fixed relationship between a particular shed retainer and fluid jet. Each shed retainer will of course receive a thread at the appropriate time from a fluid jet but it will not always be the same fluid jet.

Movement is imparted to the weft threads such that they move in generally the same direction as the retained sheds. The movement of the weft threads is also synchronized with the movement of the fluid jets such that such weft thread moves conjointly with a corresponding one of the fluid jets during its insertion into a respective retained shed.

Each fluid jet is substantially constrained within a corresponding one of the retained sheds. Such constrainment of the fluid jets has several advantages. First, the speed of the fluid jets can be more easily maintained at a velocity required for picking the weft threads. Second, inadvertent removal of the weft threads from the retained sheds is inhibited. Third, the fluid jets are inhibited from interfering with the warp threads forming the retained sheds.

Another aspect of the present invention involves a new and improved shed-retaining member for use in connection with the loom weaving of warp and weft threads into cloth of the type wherein the loom has shed-forming means for elevating some of the warp threads and depressing other of the warp threads in accordance with a predetermined pattern. The shed-retaining member is readily insertable between adjacent warp threads and into one of the sheds defined by the elevated warp threads and the depressed warp threads. The shed-retaining member has an upper surface which, in a first position of the shed-retaining member, is engageable with an elevated warp thread and a lower surface which, in the first position of the shed-retaining member, is engageable with depressed warp thread. When the shed-retaining member is in a second position, its upper and lower surfaces are disengageable from the elevated and depressed warp threads, respectively. In accordance with the improvement, the shed-retaining member includes receiving means for receiving a weft thread inserted through the shed-retaining member when said shed-retaining member is in its first position and means for permitting the removal of the weft thread from the shed-retaining member when the shed-retaining member is in its second position.

A further aspect of the present invention involves a new and improved shed retainer for insertion into a shed formed from a plurality of warp threads by elevating some of the warp threads and depressing other of the warp threads in accordance with a predetermined pattern. The shed retainer includes a first shed-retaining member and a second shed-retaining member, each of which has a bore passing therethrough. The first and second shed-retaining members are alternately insertable into said shed between adjacent warp threads. After their insertion into the shed, the first and second shed-retaining members are engaged with each other in such a manner that the bore of the first shed-retaining member is aligned with the bore of the second shed-retaining member, whereby the bores cooperate to form a continuous substantially closed channel capable of receiving a weft thread inserted through the shed generally transversely of the warp threads. Another and significant advantage of the rotatable shed retainers of the present invention resides in the fact that they need not be rotated to the degree required when employing prior art rotatable shed retainers which, generally, are rotated a full ninety degrees.

Yet another aspect of the present invention involves a new and improved method and apparatus for transporting a plurality of weft inserting devices useful in connection with flat warp-wave weaving systems employing a plurality of movable shed retainers. In accordance with the improvement, the movement of the weft-inserting devices is synchronized with the movement of the shed retainers such that each weft-inserting device moves conjointly with a corresponding one of the shed retainers during the insertion of a weft thread into the shed being retained by the corresponding shed retainer.

A still further aspect of the present invention involves a spreader mechanism for spreading apart warp threads which form a shed of warp threads. More particularly, the spreader mechanism including a spreading element which moves generally transversely of the warp threads to increase the spacing between a pair of adjacent warp threads for the purpose of assisting the insertion of a shed-retaining member into the shed between the adjacent warp threads.

BRIEF DESCRIPTION OF THE DRAWINGS

For a more complete understanding of the present invention, reference may be had to the following description of several exemplary embodiments, taken in conjunction with the accompanying figures of the drawings, in which:

FIG. 31 is a cross-sectional view of an alternate embodiment of a shed retainer constructed in accordance with the present invention;

FIG. 32 is a side elevational view, looking from the left, of the shed retainer shown in FIG. 31;

FIG. 33 is a side elevational view, looking from the right, of the shed retainer illustrated in FIG. 31;

DESCRIPTION OF THE EXEMPLARY EMBODIMENTS

Figure 1:
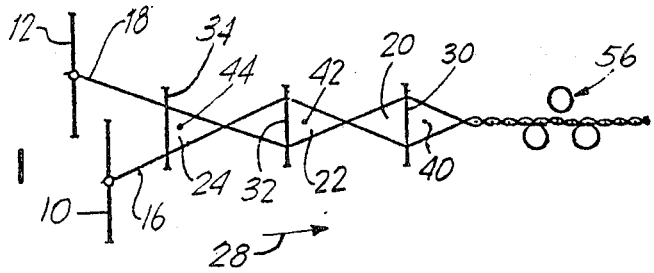
FIGS. 1–4 are schematic side elevational views of successive operating steps in a flat warp-wave weaving system.

While the present invention is applicable to curved warp-wave weaving systems and flat warp-wave weaving systems, it is especially suitable for use in connection with flat warp-wave weaving systems. Thus, the present invention will be described with particular reference to a flat warp-wave weaving system.

Referring to FIGS. 1–4 of the drawings, there is illustrated schematically four successive steps in the weaving of cloth or the like in accordance with a flat warp-wave weaving system. Conventional shed-forming means 10, 12 change the position of warp threads 16, 18 in accordance with a preselected pattern to successively form a plurality of sheds 20, 22, 24 and 26 which progress generally from left to right as indicated by arrow 28 in a manner to be described more fully hereinafter. After the sheds are formed in a conventional manner, releasable shed-retainers 30, 32, 34, 36 and 38 are inserted therein so as to maintain the sheds 20, 22, 24 and 26 open as they travel in a substantially straight line in the direction of the arrow 28, i.e., toward the fell of the cloth. During the time that the sheds 20, 22, 24 and 26 are maintained open by the shed retainers 30, 32, 34 and 36, respectively, weft threads 40, 42, 44 and 46 are inserted into the sheds 20, 22, 24 and 26, respectively. If it is desired to compensate for tension variations caused by the release of the sheds 20, 22, 24 and 26, a tension compensation mechanism 56 may be employed. The tension compensation mechanism 56 includes a series of rollers adapted to engage the woven fabric and move in timed sequence with the release of the sheds 20, 22, 24 and 26.

Figure 2:
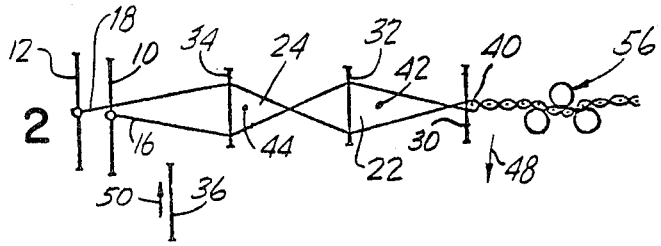

In FIG. 2, the shed 20 (see FIG. 1) has been released by the shed retainer 30 and the beat up of the weft thread 40 is accomplished, by any suitable means, as the shed-retainer 30 begins to move in a direction indicated by arrow 48. Meanwhile, the shed retainer 36 is about to be inserted adjacent the shed-forming means 10, 12 as indicated by arrow 50.

Figure 3:
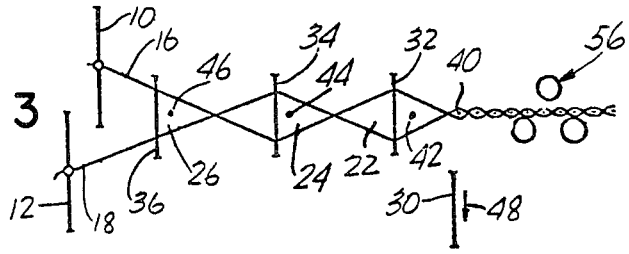

As shown in FIG. 3, the shed retainer 30 moves away from the cloth in the direction indicated by the arrow 48. The shed retainer 36 has moved into position to maintain the shed 26 in its open position.

Figure 4:
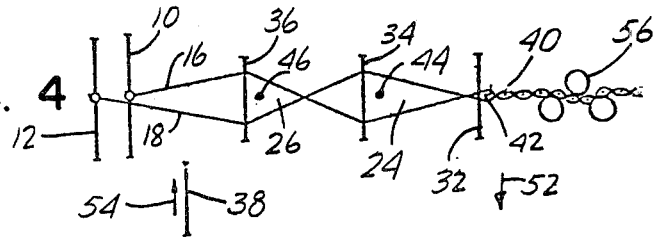
Figure 5:
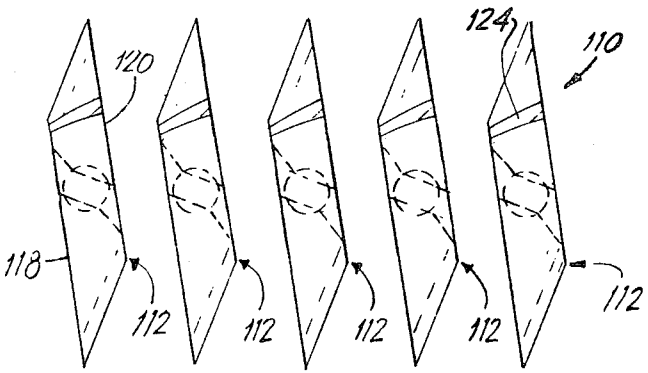
FIG. 5 is a plan view of a plurality of shed-retaining members constructed in accordance with the present invention, the shed-retaining members being positioned in an open or shed-releasing position.
Figure 6:
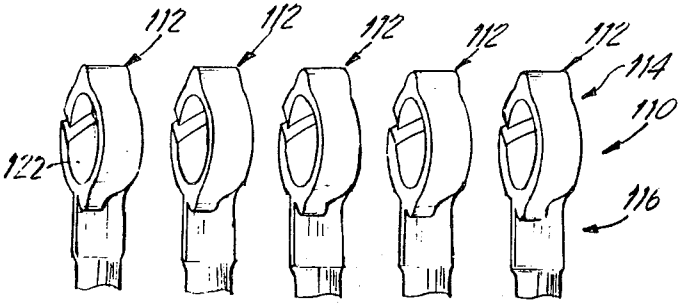
FIG. 6 is a front elevational view of the shed-retaining members illustrated in FIG. 5.
Figure 7:
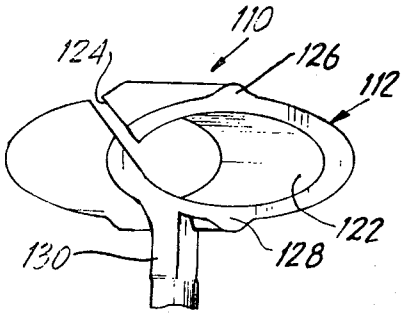
FIG. 7 is a side elevational view of the shed-retaining members illustrated in FIGS. 5 and 6.
Figure 8:
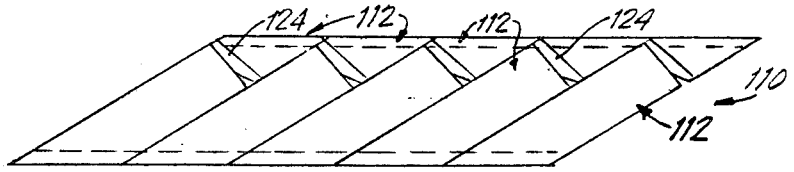
FIG. 8 is a plan view of the shed-retaining members of FIGS. 5–7, the shed-retaining members being positioned in a closed or shed-retaining position.
Figure 9:
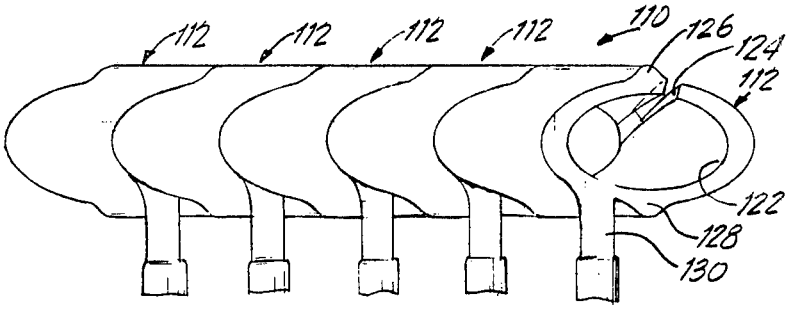
FIG. 9 is a front elevational view of the shed-retaining members illustrated in FIG. 8.
Figure 10:
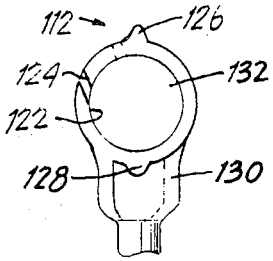
FIG. 10 is a side elevational view, looking from the left, of the shed-retaining members shown in FIGS. 8 and 9.
Figure 11:
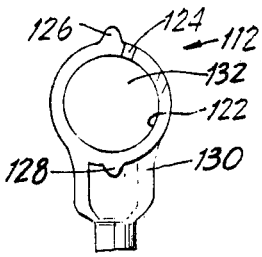
FIG. 11 is a side elevational view, looking from the right, of the shed-retaining members illustrated in FIGS. 7, 8 and 9.

In FIG. 4, the shed retainer 32 has released the shed 22 (see FIGS. 1–3) and the beat up of the weft thread 42 is ready to begin as the shed retainer 32 starts to move in a direction indicated by arrow 52. The shed retainer 38, moving in a direction indicated by arrow 54, is about to be inserted between the warp threads 16, 18.

One shed-retainer embodiment is illustrated in FIGS. 5–11. A shed retainer 110 constructed in accordance with this embodiment includes several shed-retaining members 112. Each of the shed-retaining members 112 includes a tubular section 114 which is carried by a stem 116. The tubular section 114 includes a pair of parallel sides 118, 120 and a bore 122 which extends through the tubular section 114 between the sides 118, 120. The central longitudinal axis of the bore 122 is generally parallel to the longitudinal axis of the tubular section 114 for engaging a multiplicity of elevated warp threads in a manner to be described hereinafter. The tubular section 114 also includes a slot 124 which communicates with the bore 122 and extends between the sides 118, 120 in a direction which is not parallel to the central longitudinal axis of the bore 122. Though the slot 124 in the illustrated embodiment is angled in the direction of fluid flow, the direction of the slots could be in opposition to fluid flow, i.e., the position of the slots can be varied from the illustrated position. A ridge 126 extends across an upper surface of the tubular section 114 for engaging a multiplicity of elevated warp threads in a manner to be described hereinafter. Extending across a lower surface of the tubular section 114 is another ridge 128 which is designed to engage a multiplicity of depressed warp threads in a manner to be described hereinafter. Like the ridge 126, the ridge 128 also extends in a direction which is generally parallel to the central longitudinal axis of the bore 122.

The stem 116 is attached to the lower surface of the tubular section 114 intermediate opposite ends of the ridge 128. The end of the stem 116 which is attached to the tubular section 114 includes a flattened, flared section 130. The stem 116 supports the tubular section 114 for rotation between two positions. In one position, i.e., a warp thread engaging position, the side 116 of the tubular section 114 of each of the shed-retaining members 112 is adapted to abut the side 118 of the tubular section 114 of an adjacent one of the shed-retaining members 112, while the side 118 of the tubular section 114 of each of the shed-retaining members 112 is adapted to abut the side 120 of the tubular section 114 of an adjacent one of the shed-retaining members 112. When each of the shed-retaining members 112 is in its warp thread engaging position, the shed-retainer 110 assumes a shed-retaining position (see FIGS. 8 and 9), in which the bores 122 of the shed-retaining members 112 cooperate to form a continuous substantially closed channel 132. When the shed-retainer 110 is in its shed-retaining position, the slots 124 are misaligned (see FIG. 8).

In another position, i.e., a warp thread disengaging position, the side 120 of the tubular section 114 of each of the shed-retaining members 112 is adapted to be spaced from the side 118 of the tubular section 114 of an adjacent one of the shed-retaining members 112, while the side 118 of the tubular section 114 of each of the shed-retaining members 112 is adapted to be spaced from the side 120 of the tubular section 114 of an adjacent one of the shed-retaining members 112. When each of the shed-retaining members 112 is in its warp thread disengaging position, the shed retainer 110 assumes a shed-releasing position in which the slots 124 of the shed-retaining members 112 are in substantial alignment with each other (see FIGS. 5, 6 and 7).

FIGS. 12–17 show successive steps in the operation of a flat warp-wave weaving loom 134 employing the shed-retainer embodiment of FIGS. 5–11. Referring, in general, to FIGS. 12–17, six carriages 136*a*, 136*b*, 136*c*, 136*d*, 136*e*, and 136*f* are provided, each carriage extending across the width of the loom 134. The carriages 136*a*, 136*b*, 136*c*, 136*d*, 136*e*, and 136*f*, which are mounted on an endless conveyor 140 driven in a clockwise direction by rollers 142, carry shed-retainers 110*a*, 110*b*, 110*c*, 110*d*, 110*e*, and 110*f*, respectively, and weft-advancing arms 138*a*, 138*b*, 138*c*, 138*d*, 138*e*, and 138*f*, respectively. The weft-advancing arms 138*a*, 138*b*, 138*c*, 138*d*, 138*e* and 138*f* are optional, inasmuch as shed-retaining members 112*a*, 112*b*, 112*c*, 112*d*, 112*e* and 112*f* which form the shed retainers 110*a*, 110*b*, 110*c*, 110*d*, 110*e* and 110*f*, respectively, may function to advance released weft threads to a position where the released weft threads can be contacted by a suitable beat-up mechanism, which will be described hereinafter. Heddles 144, which are conventional shed-forming means in the weaving industry, elevate warp threads 146 and depress warp threads 148 in accordance with a predetermined pattern to successively form a plurality of sheds in the manner illustrated in FIGS. 1–4. A spreading mechanism 150, the construction and operation of which will be described in greater detail hereinafter, is positioned between the heddles 144 and the conveyor 140 to effect preliminary lateral spacing of the warp threads 146, 148. By spacing the warp threads 146, 148, te spreading mechanism 150 ensures that each of the shed-retaining members 112*a*, 112*b*, 112*c*, 112*d*, 112*e* and 112*f* of the shed retainers 110*a*, 110*b*, 110*c*, 110*d*, 110*e* and 110*f*, respectively, will always be inserted into a newly formed shed between the same two warp threads as the corresponding one of the shed-retaining members 112*a*, 112*b*, 112*c*, 112*d*, 112*e* and 112*f* of the preceding one of the shed retainers 110*a*, 110*b*, 110*c*, 110*d*, 110*e* and 110*f*, respectively. Although the shed-retaining members 112*a*, 112*b*, 112*c*, 112*d*, 112*e* and 112*f* of the shed retainers 110*a*, 110*b*, 110*c*, 110*d*, 110*e* and 110*f* could be inserted into the sheds without the benefit of the spreading mechanism 150, the spreading mechanism 150 does assist in the insertion of the shed-retaining members 112, resulting in less friction on the warp threads 146, 148. By eliminating the weft-advancing arms 138*a*, 138*b*, 138*c*, 138*d*, 138*e* and 138*f*, the wear on the warp threads 146, 148 would be further reduced. The elimination of the weft-advancing arms 138*a*, 138*b*, 138*c*, 138*d*, 138*e* and 138*f* would also permit the loom 134 to be more compact.

Figure 12:
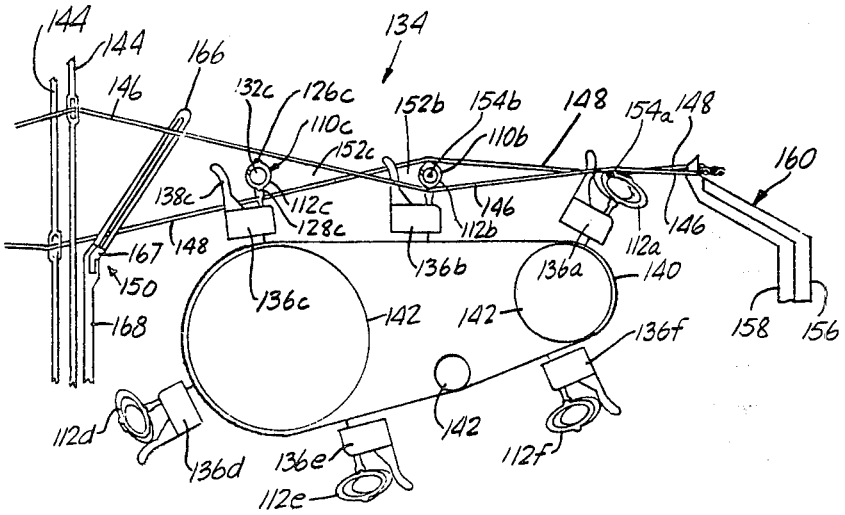
FIGS. 12–17 are side elevational views showing the successive steps in the operation of a flat warp-wave weaving system constructed in accordance with the present invention and employing the shed-retaining members of FIGS. 5–11.

With reference to FIG. 12 specifically (which illustrates the same instant in time as FIGS. 19 and 25), the shed-retainer 110*c* has just been inserted into shed 152*c*, the shed-retainer 110*c* having been moved to its shed-retaining position in preparation for the insertion of a weft thread into a substantially closed channel 132*c* formed by the shed-retaining members 112*c* which constitute the shed-retaining 110*c*. The shed-retainer 110*b* is shown retaining a shed 152*b*. A weft thread 154*b*, which has been inserted through about 60% of the length of the shed-retainer 110*b*, is shown in a substantially closed channel formed by the shed-retaining members 112*b* which constitute the shed-retainer 110*b*. As can be seen, the threads 146, 148 are engaged by ridges 126*c*, 128*c*, respectively. Although the ridges 126*c*, 128*c* minimize wear on the threads 146, 148, respectively, the ridges 126*c*, 128*c* are not necessary and, therefore, may be omitted from the shed-retaining members 112*c*. A weft thread 154*a* is in the process of being removed from the shed-retainer 110*a* which has just assumed its shed-releasing position, the weft thread 154*a* being removed through slots 124 formed in the shed-retaining members 112*a* which constitute the shed-retainer 110*a*. After the removal of the weft thread 154*a* from the shed-retainer 110*a*, the weft-advancing arm 138*a* will advance the weft thread 154*a*, which has been trapped between the warp threads 146, 148, towards a beat-up mechanism 160, the construction and operation of which is described in detail in the applicant's pending U.S. patent application Ser. No. 149,479 filed on May 13, 1980. The shed retainer 110*a*, like the shed-retainers 110*d*, 110*e*, and 110*f*, remains in its shed-releasing position until it has been inserted into another shed formed by the heddles 144.

Figure 13:
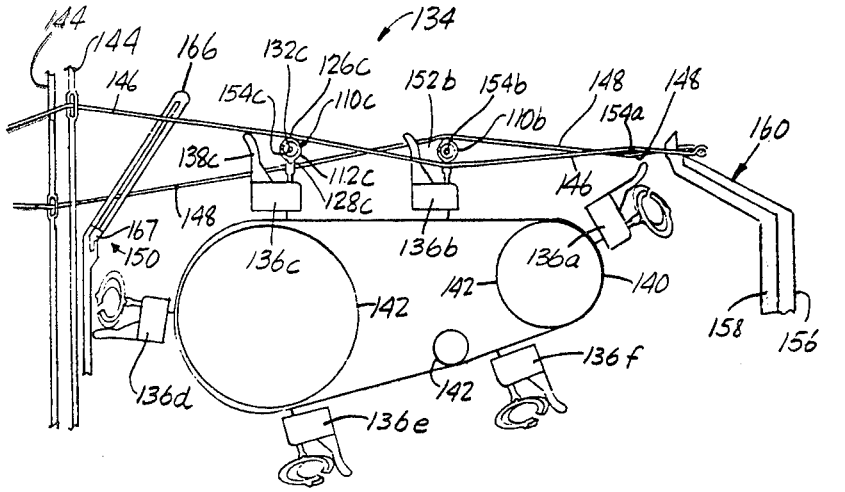

In FIG. 13 (which illustrates the same instant in time as FIGS. 20 and 26), the shed retainer 110*c* is shown retaining the shed 152*c*. A weft thread 154*c* has been inserted through about 10% of the length of the shed-retainer 110*c*, while the weft thread 154*b* has been inserted through about 70% of the length of the shed-retainer 110*b*. The shed-retainers 110*a*, 110*b*, 110*e* and 110*f* are maintained in their shed-releasing positions as they travel in a clockwise direction along the conveyor 140. the beat-up mechanism 160, which includes a plurality of beat-up elements 158 and a plurality of spacer elements 156, is shown beginning its travel toward the weft thread 154*a* which has been trapped between the warp threads 146, 148.

Figure 14:
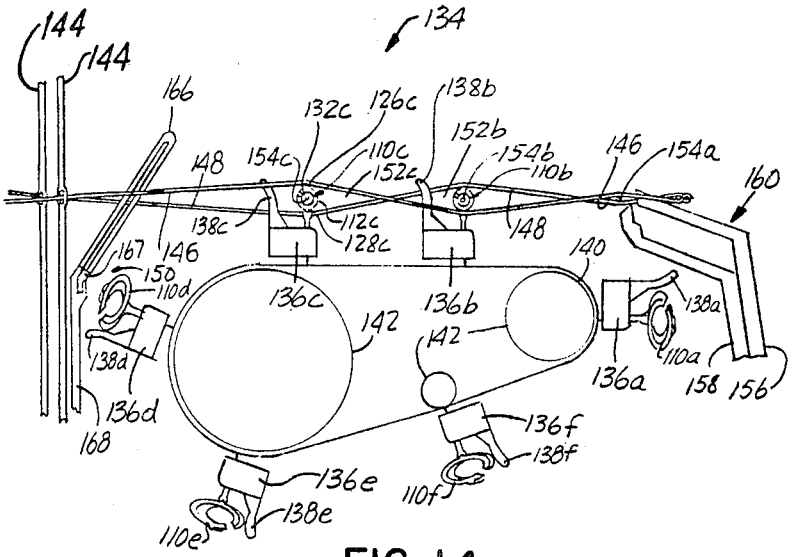

As shown in FIG. 14 (which illustrates the same instant in time as FIGS. 21 and 27), the weft thread 154*c* has been inserted through about 20% of the length of the shed-retainer 110*c*, while the weft thread 154*b* has been inserted through about 80% of the length of the shed-retainer 110*b*. The shed-retainer 110*a*, 110*b*, 110*e*, and 110*f* are maintained in their shed-releasing positions as they continue their travel in a clockwise direction along the conveyor 140. The beat-up mechanism 156 continues its movement toward the weft thread 154*a*. During this movement of the beat-up mechanism 160, the beat-up elements 158 are withdrawn from between the warp threads 146, 148, while the spacer elements 156 are inserted between the warp threads 146, 148 to maintain the proper spacing of the warp threads 146, 148.

Figure 15:
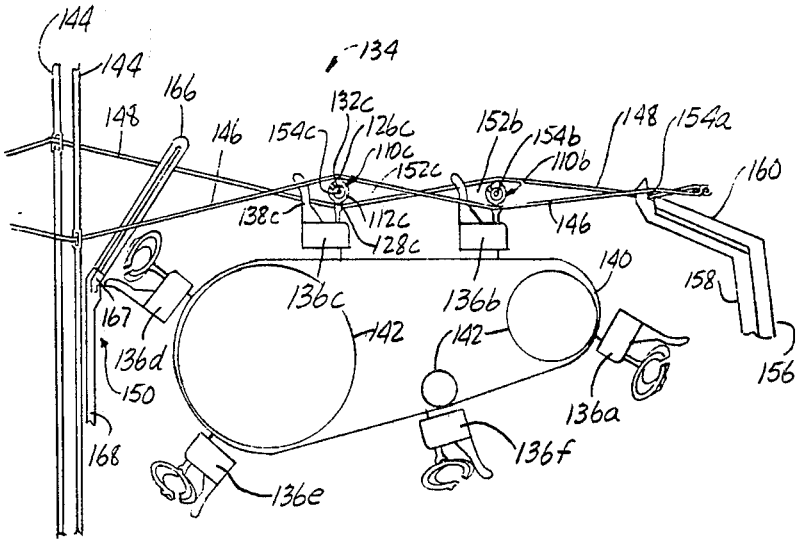

With reference to FIG. 15 (which illustrates the same instant in time as FIGS. 22 and 28), the weft thread 154*c* has been inserted through about 30% of the length of the shed-retainer 110*c*, while the weft thread 154*b* has been inserted through about 90% of the length of the shed retainer 110*b*. The shed retainers 110*a*, 110*d*, 110*e*, and 110*f* are maintained in their shed-releasing positions as they continue their travel in a clockwise direction along the conveyor 140, the shed-retainer 110*d* getting ready to be inserted into a shed 154*d* formed by the heddles 144. The beat-up elements 158 of the beat-up mechanism 160 have been reinserted between the warp threads 146, 148 on the far side of the weft thread 154*a*, permitting the spacer elements 156 of the beat-up mechanism 156 to be withdrawn from between the warp threads 146, 148.

Figure 16:
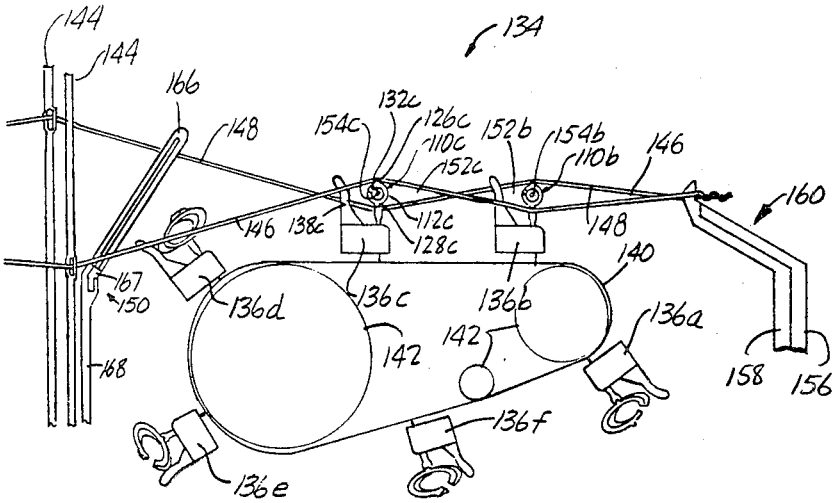

Referring now to FIG. 16 (which illustrates the same instant in time as FIGS. 23 and 29), the weft thread 154*c* has been inserted through about 40% of the length of the shed-retainer 110*c*, while the weft thread 154*b* has just been completely inserted through the shed-retainer 110*b*. The shed-retainers 110*a*, 110*d*, 110*e*, and 110*f* are maintained in their shed-releasing positions as they continue their travel in a clockwise direction along the conveyor 140, the shed-retainer 110*d* having just been inserted into a shed 154*d* in a manner to be described in greater detail hereinafter. The beat-up mechanism 160 has just finished beating-up the weft thread 154*a*. As a result, the beat-up mechanism 156 is in essentially the same position that it assumed in FIG. 12.

Figure 17:
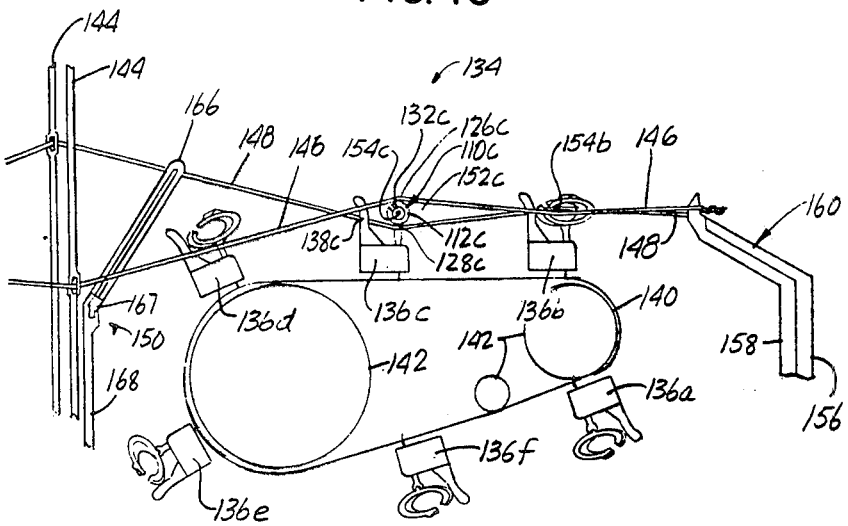

As shown in FIG. 17 (which is the view represented by the arrows 17—17 in FIG. 18 and which illustrates the same instant in time as FIGS. 18, 24 and 30), the weft thread 154*c* has been inserted through about 50% of the length of the shed-retainer 110*c*. The shed-retainer 110*b* has just assumed its shed-releasing position, resulting in the entrapment of the weft thread 154*b* between the warp threads 146, 148. Flattened and flared sections 130 on stems 116, which support the shed-retaining members 112*b* for rotation between their warp thread engaging positions and their warp thread disengaging positions, facilitate the release of the warp threads 146 from the shed-retainer 110*b* by laterally moving at least some of the warp threads 146 further apart during rotation of the stem 116, thereby facilitating the withdrawal of warp threads 146 from underneath the shed-retaining members 112*b*. The lateral movement of the warp threads 146 is accomplished by positioning the wide faces of the flattened and flared sections 130*b* generally transversely of the warp threads 146 (see FIG. 6). The flattened and flared sections 130*b* of the stems 116*b* are also designed so as to minimize the spreading of warp threads 146 located on opposite sides of each of the stems 116*b* during shed retention, thereby minimizing wear on the warp threads 146. The spacing between the warp threads 146 on opposite sides of each of the stems 116*b* is minimized by positioning the wide faces of the flattened and flared sections 130*b* generally parallel to the warp threads 146 (see FIG. 9). The weft thread 154*b* is still positioned in bores 122*b* provided in the shed-retaining members 112*b* prior to its removal from the shed-retaining members 112*b* throuh slots 124*b*, which are also provided in the shed-retaining members 112*b*. The shed-retainer 110*d* is now completely inserted into the shed 152*d*. The shed-retaining members 112*d* of the shed-retainer 110*d* have begun to rotate from their warp thread releasing positions to their warp thread engaging positions. The rotation of the shed-retaining members 112*d*, as well as the shed-retaining members 112*a*, 112*g*, 112*c*, 112*e* and 112*f*, can be accomplished by any suitable means, such as the rack and pinion arrangement illustrated in FIGS. 21–23 of the applicant's U.S. Pat. No. 4,122,871. The shed-retainers 110*a*, 110*e*, and 110*f* are maintained in their shed-releasing positions as they continue their travel in a clockwise direction along the conveyor 140. The beat-up mechanism 156 is still in basically the same position it assumed in FIG. 16. However, the beat-up mechanism 156 will be shortly beginning its movement toward the weft thread 154*b* to perform another beat-up operation.

Figure 18:
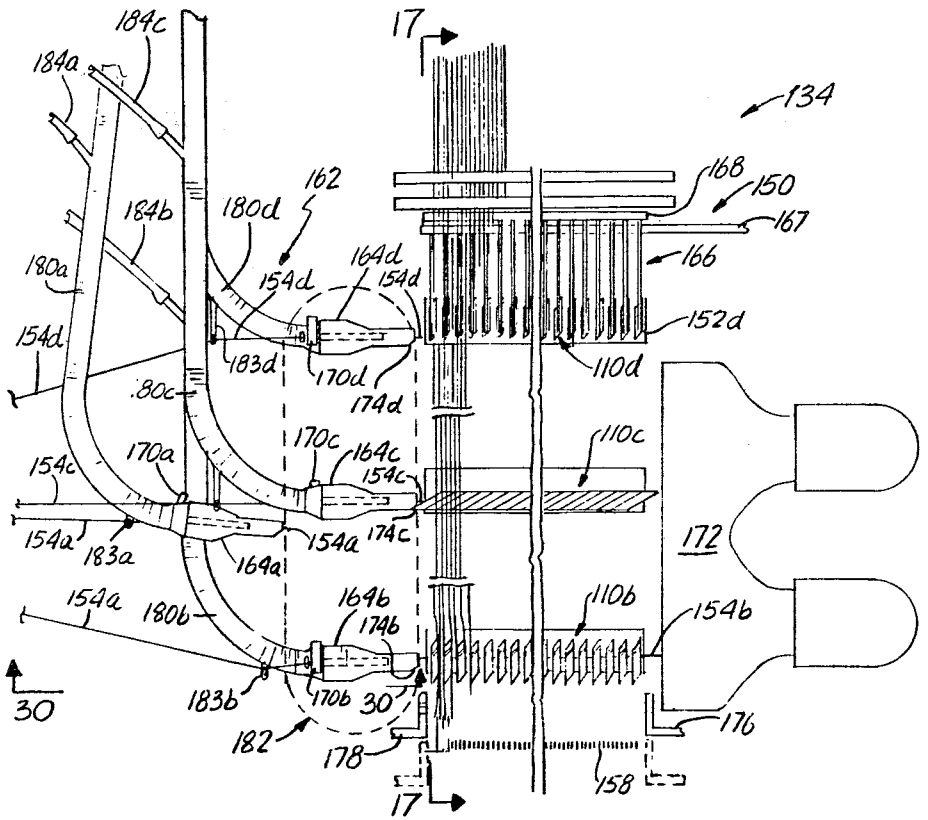
FIG. 18 is a plan view of the flat warp-wave weaving system illustrated in FIG. 17.

FIG. 18 is a plan view of the flat warp-wave loom 134 in the operating stage illustrated in FIG. 17. There is shown in FIG. 18 a weft-insertion mechanism 162, including air jets 164*a*, 164*b*, 164*c*, 164*d* of any type conventionally used in the weaving industry heretofore. The air jets 164*b*, 164*c* and 164*d* are associated with the shed-retainers 110*b*, 110*c*, and 110*d*, respectively, in the portion of the cycle illustrated in the drawings. Obviously, this relationship will change in the next cycle as there are four air jets and six shed retainers.

As indicated above in connection with the description of FIG. 17, the shed-retainer 110*d* has just been inserted into the shed 152*d*, the shed-retaining members 112*d* having been slightly rotated in a clockwise direction from their warp thread disengaging positions toward their warp thread engaging positions so that they are generally parallel to the warp threads 146, 148. By positioning the shed-retaining members 112*d* in their warp thread disengaging positions during the insertion of the shed-retaining members 112*d* into the shed 152*d*, the insertion of the shed-retaining members 112*d* is facilitated as a result of the easier positioning of the leading edges of the shed-retaining members 112*d* between adjacent pairs of the warp threads 146 (see FIG. 5). The spreading means 150 is employed to form openings in the shed 152*d* large enough to further facilitate the passage of the shed-retaining members 112*d* from the exterior of the shed 152*d* to the interior of the shed 152*d* between adjacent pairs of the warp threads 146. More particularly, the spreading means 150 includes a plurality of generally U-shaped spreader elements 166, one leg of each of the spreader elements 166 being fixedly connected to a base 168 which extends across the width of the loom 134. The other leg of each of the spreader elements 166 is attached to a reciprocating bar 167 which moves transversely of the loom 134 to spread apart the warp threads 146 at a number of locations spaced along the width of the loom 134, each location corresponding to the location of a respective one of the shed-retaining members 112*d* as the shed-retaining members 112*d* approach the shed 152*d*. Once the shed-retaining members 112*d* are inserted to a desired extent into the shed 152*d*, the spreader elements 166 permit the warp threads 146 to return to their original positions.

The air jet 164*d* has not yet begun to insert the weft thread 154*d*. A brake 170*d* associated with the air jet 164*d* holds the weft thread 154*d* until the air jet 154*d* is ready to begin the insertion of the weft thread 154*d* through the shed-retaining members 112*d* when they are fully rotated from their warp thread disengaging positions into their warp thread engaging positions.

The air jet 164c is shown moving conjointly with the shed-retainer 110c, which is in its shed-retaining position. A brake 170c associated with the air jet 164c is disengaged to permit the insertion of the weft thread 154c during the conjoint movement of the shed-retainer 110c and the air jet 164c. A stationary vacuum 172 assists the air jet 164c in the insertion of the weft thread 154c. The vacuum 172 is also adapted to assist the air jets 164a, 164b, and 164d.

The air jet 164c is adapted to contact the shed-retainer 110c during the insertion of the weft thread 154c by providing the air jet 164c with a notch 174c which receives an edge of the shed-retainer 110c. The air jets 164a, 164b, and 164d are provided with similar notches 174a, 174b, and 174d, respectively. It is possible to design the air jets 164a, 164b, 164c and 164d (and the tubular sections 114) such that they will substantially mate over their entire openings, the shed retainers 110a, 110b, 110c, 110d, 110e and 110f thereby becoming extensions of the nozzles of the air jets during their conjoint movement therewith.

The air jet 164b has just completed the insertion of the weft thread 154b through the shed retainer 110b. Any conventional weft-detection device is made part of the shed retainer 110b at the end thereof remote from the air jet 164b. The weft-detection device operates to actuate a brake 170b associated with the air jet 164b when the weft thread 154b has been completely inserted through the shed-retainer 110b. Alternatively, the brake 170b can be actuated by a feed mechanism, which also functions in a conventional manner to premeasure the weft thread 154b prior to its insertion into the shed retainer 110b (see, for instance, U.S. Pat. No. 4,084,623). While further insertion of the weft thread 154b is being prevented by the brake 170b, the shed-retaining members 112b are rotated from their warp thread engaging position to their warp thread disengaging position. After the weft thread 154b has been removed from the shed-retaining members 112b, a clamp 176 clamps the inserted end of the weft thread 154b, while a clamp and cutter 178 clamps and cuts the weft thread 154b at a point between the shed retainer 110b and the air jet 164b. The severed weft thread 154b is then beat up into the fell of the cloth by the beat-up mechanism 156. It will be noted from U.S. Pat. No. 4,122,872 that the clamps move in synchronism with the beat-up mechanism to the fell of the cloth. Leno mechanisms may also be used to form the selvedges.

The air jets 164a, 164b, 164c, and 164d and the brakes 170a, 170b, 170c, and 170d are carried by arms 180a, 180b, 180c, and 180d, respectively, which operate so as to cause the air jets 164a, 164b, 164c, and 164d to move in a closed path 182. The arms 180a, 180b, 180c, and 180d are provided with guides 183a, 183b, 183c, and 183d, respectively, for guiding the weft threads 154a, 154b, 154c, and 154d, respectively. Conduits 184a, 184b, 184c, and 184d, which supply compressed air to the air jets 164a, 164b, 164c, and 164d, respectively, are also attached to the arms 180a, 180b, 180c, and 180d, respectively. In addition to moving the air jets 164b, 164c, and 164d conjointly with the shed-retainers 110b, 110c, and 110d, respectively, during the insertion of the weft threads 154b, 154c, and 154d into the shed-retainers 110b, 110c, and 110d, respectively, the arms 180b, 180c, and 180d also move the weft threads 154b, 154c, and 154d, respectively, conjointly with the shed-retainers 110b, 110c, and 110d, respectively, during the insertion of the weft threads 154b, 154c, and 154d into the shed-retainers 110b, 110c, and 110d, respectively. The movement of the arms 180a, 180b, 180c, and 180d is such that they do not interfere with each other during the movement of the air jets 164a, 164b, 164c, and 164d along the closed path 182. The movement of the arms 180a, 180b, 180c, and 180d also prevents interference between the conduits 184a, 184b, 184c, and 184d. Interference between the weft threads 154a, 154b, 154c, and 154d, which are supplied from stationary sources, is also prevented by the movement of the arms 180a, 180b, 180c, and 180d.

Figure 19:
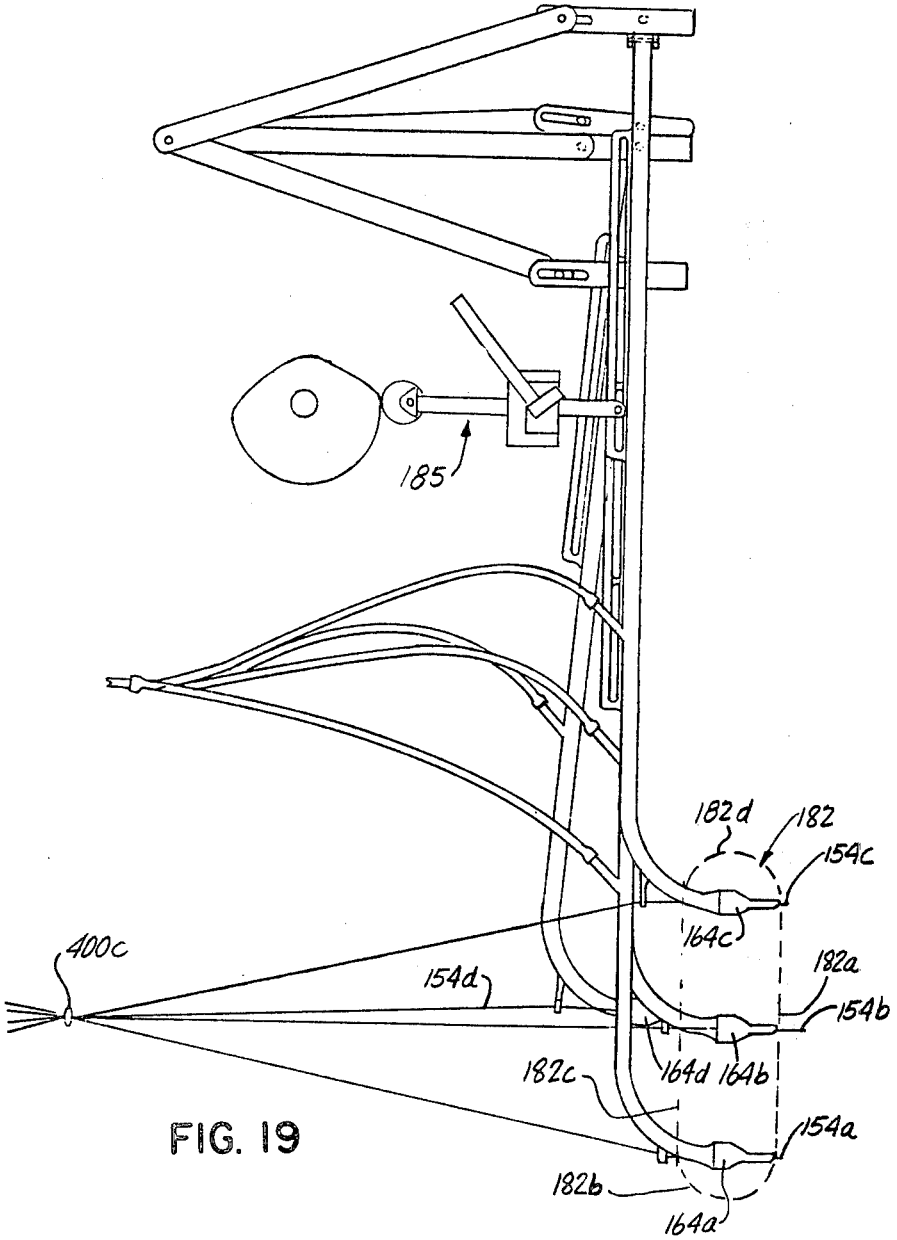
FIGS. 19–24 are plan views showing the successive steps in the movement of a plurality of air jets used in connection with the flat warp-wave weaving system of FIGS. 11–17, respectively.
Figure 23:
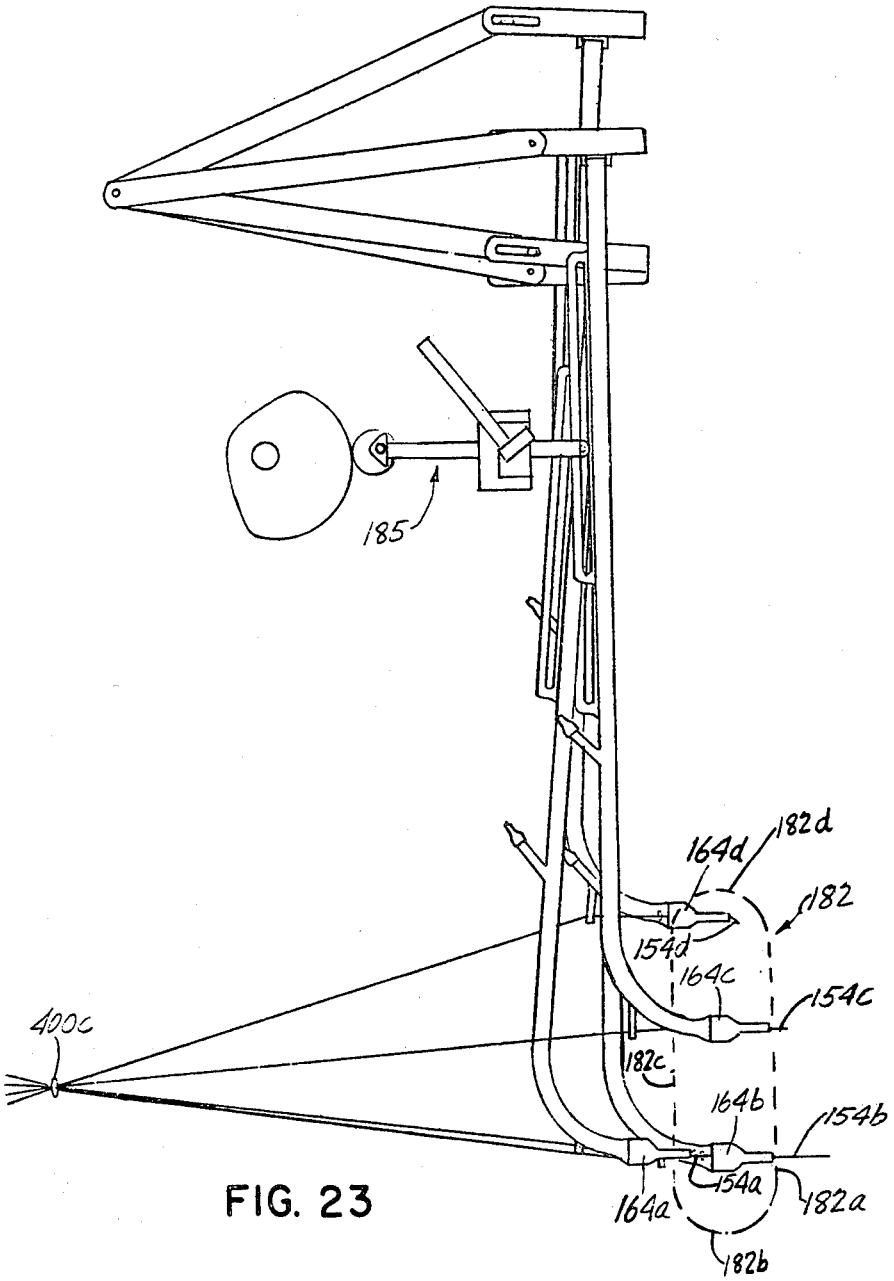
Figure 24:
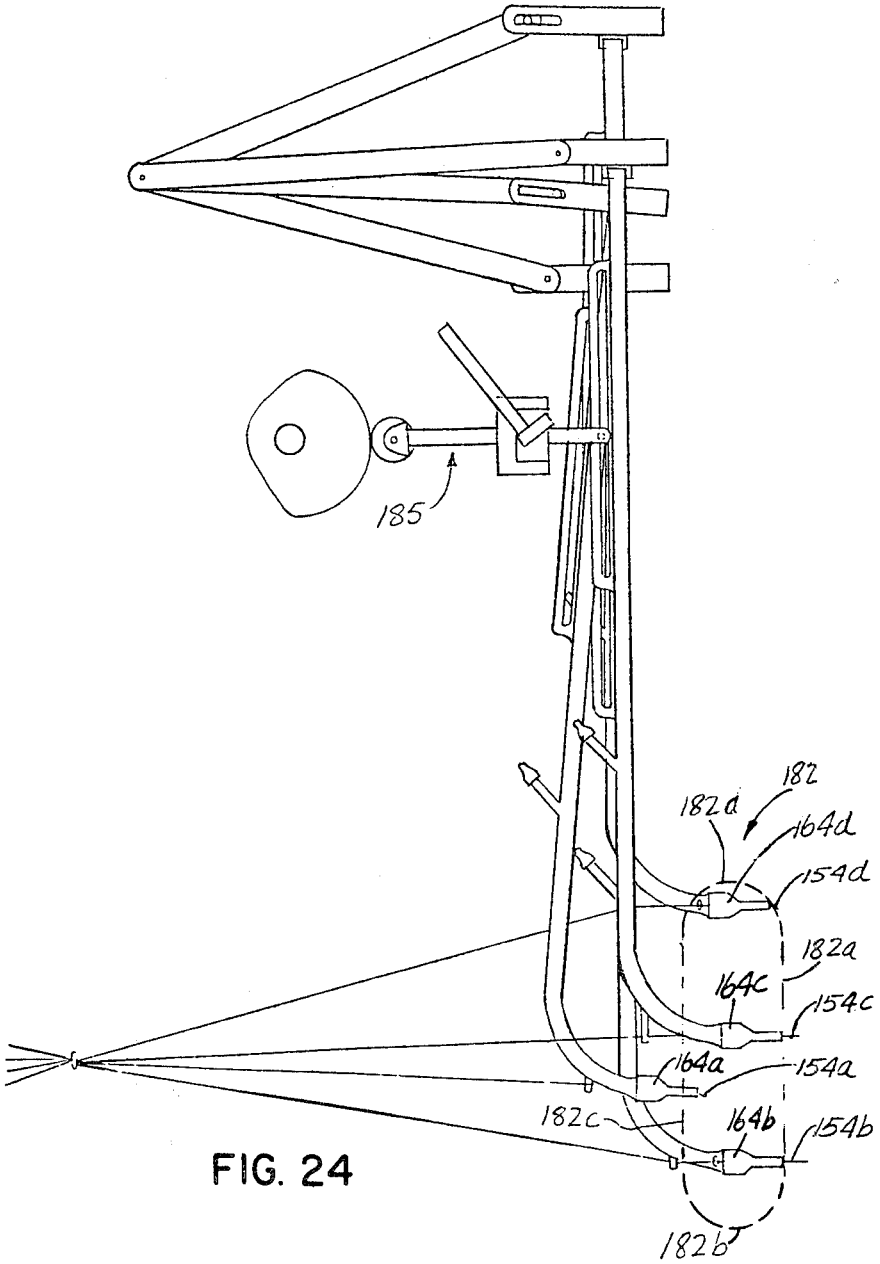
Figure 25:
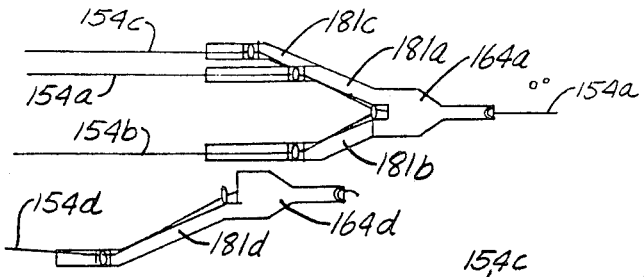
FIGS. 25–30 are side elevational views showing the successive steps in the movement of the air jets shown in FIGS. 19–24, respectively.

FIGS. 19–30 show the successive steps in the movement of the air jets 164a, 164b, 164c, and 164d along the closed path 182. With reference to FIGS. 19 and 25, the air jets 164a, 164b, and 164c are positioned along a leg 182a of the closed path 182, while the air jet 164d is positioned along a leg 182c of the closed path 182 at a lower elevation than the air jets 164a, 164b and 164c (see FIG. 25). More particularly, the air jet 164c is positioned in readiness for inserting the weft thread 154c. The weft thread 154b is in the process of being inserted by the air jet 164b. The air jet 164a has just completed the insertion of the weft thread 154a. Although the air jets 164a, 164b, and 164c are arranged at the same elevation, the arms 180a, 180b, and 180c are provided with elbows 181a, 181b, 181c, respectively, of different lengths so that the arms 180a, 180b, and 180c can be arranged at different elevations to prevent them from interfering with each other (see FIG. 25). Like the air jet 164d, which is positioned below the arms 180a, 180b and 180c of the air jets 164a, 164b, and 164c, respectively, the arm 180d is also positioned below the arms 180a, 180b, and 180c.

Figure 20:
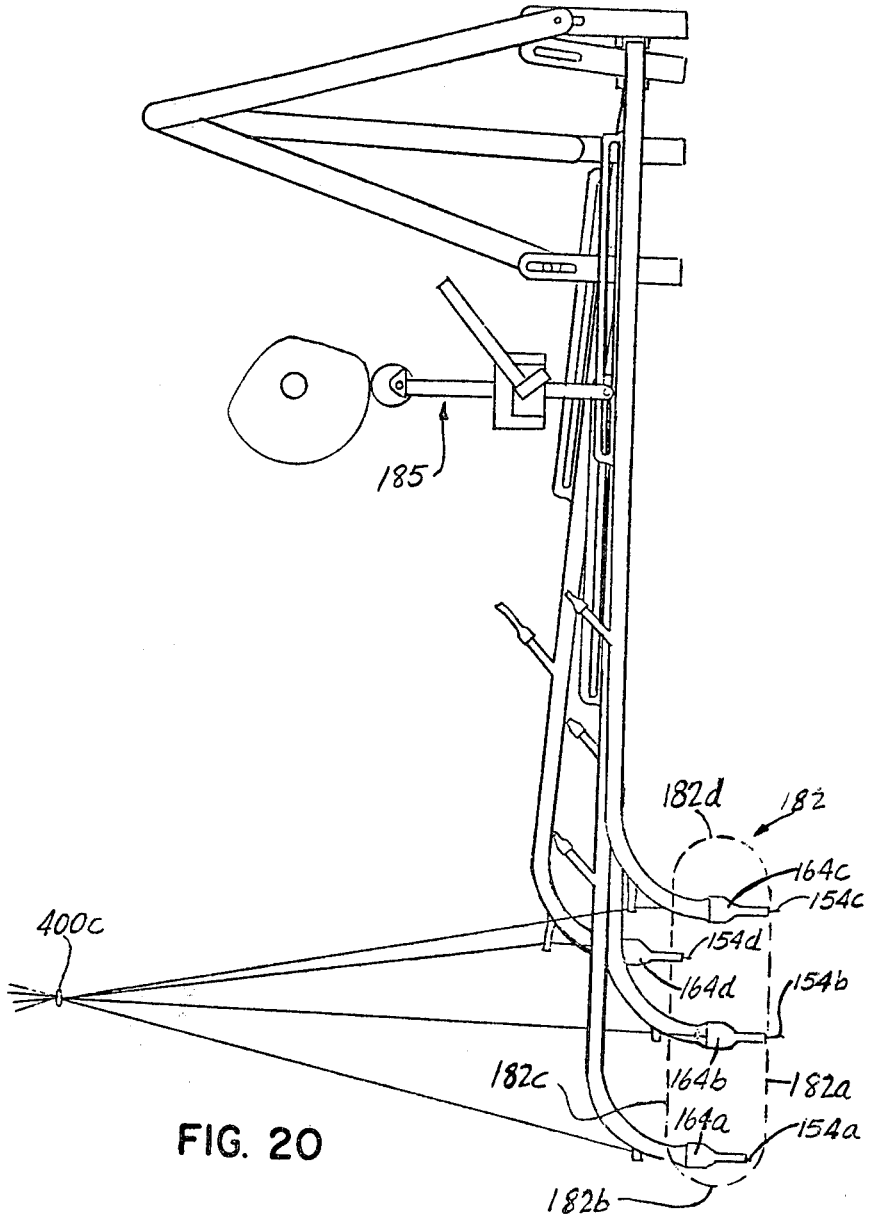
Figure 26:
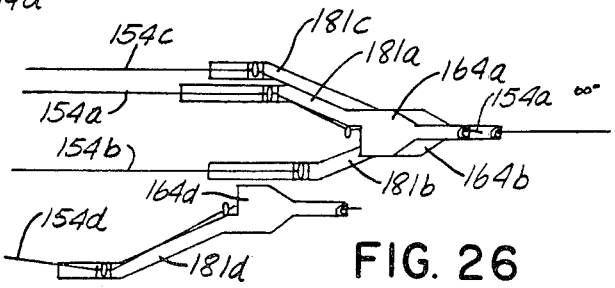

In FIGS. 20 and 26, the air jets 164b and 164c, which are in the process of inserting the weft threads 154b and 154c, respectively, have moved toward the fell along the leg 182a of the closed path 182, while the air jet 164d has moved away from the fell along the leg 182c of the closed path 182. The air jet 164a has begun to move along the curved leg 182b of the closed path 182.

Figure 21:
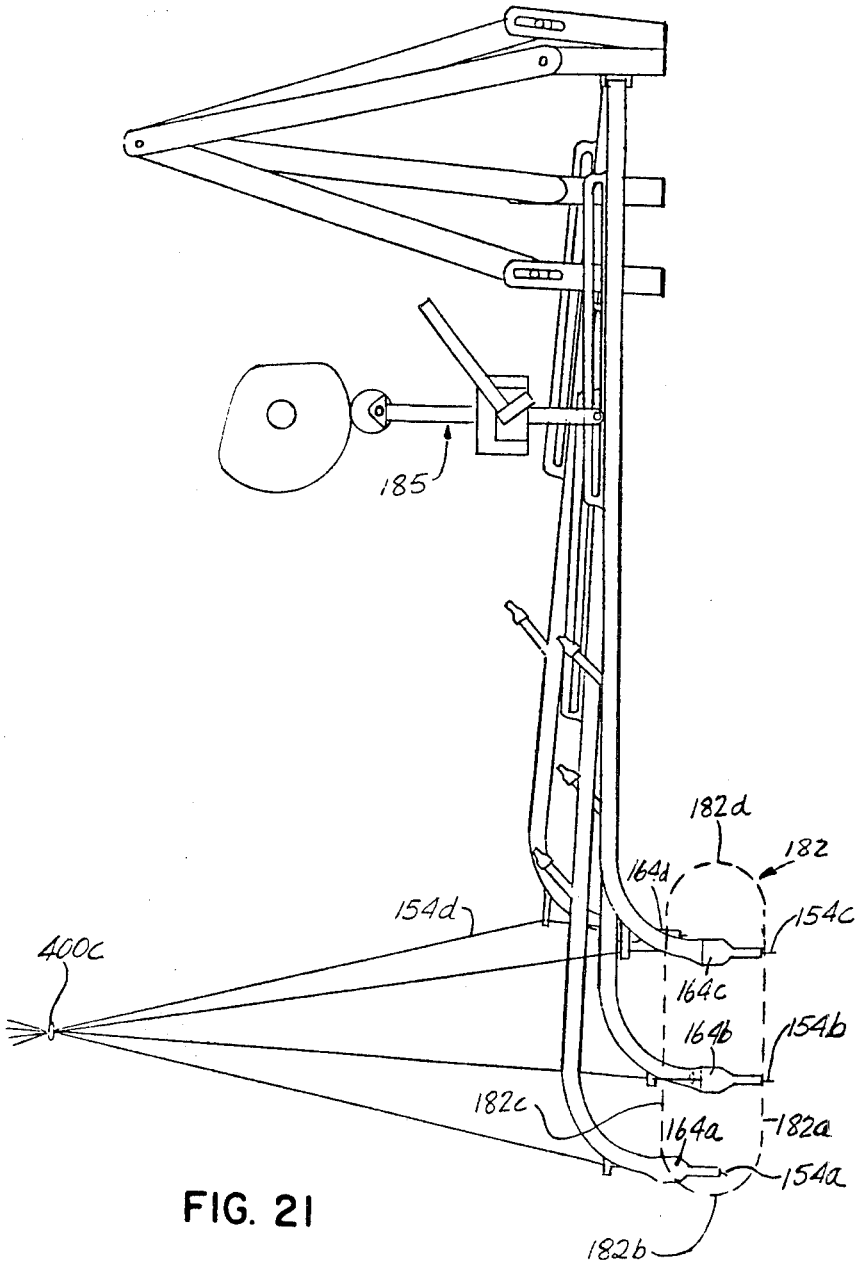
Figure 27:
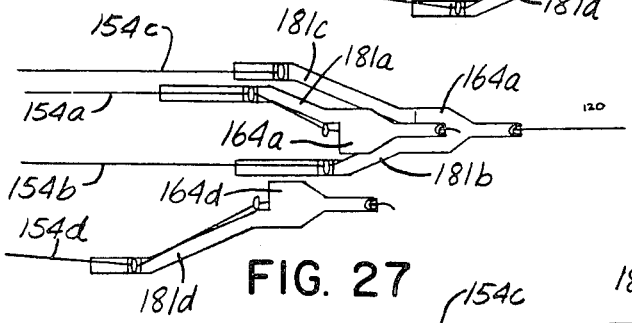

With reference to FIGS. 21 and 27, the air jets 164b and 164c, which are still inserting the weft threads 154b and 154c, respectively, have moved further toward the fell along the leg 182a of a closed path 182. The air jet 164a is still positioned on the leg 182b of the closed path 182. The air jet 164d has moved from the leg 182c of the closed path 182 to the curved leg 182d of the closed path 182, the air jet 164d still being at a lower elevation than the air jets 164a, 164b and 164c (see FIG. 27).

Figure 22:
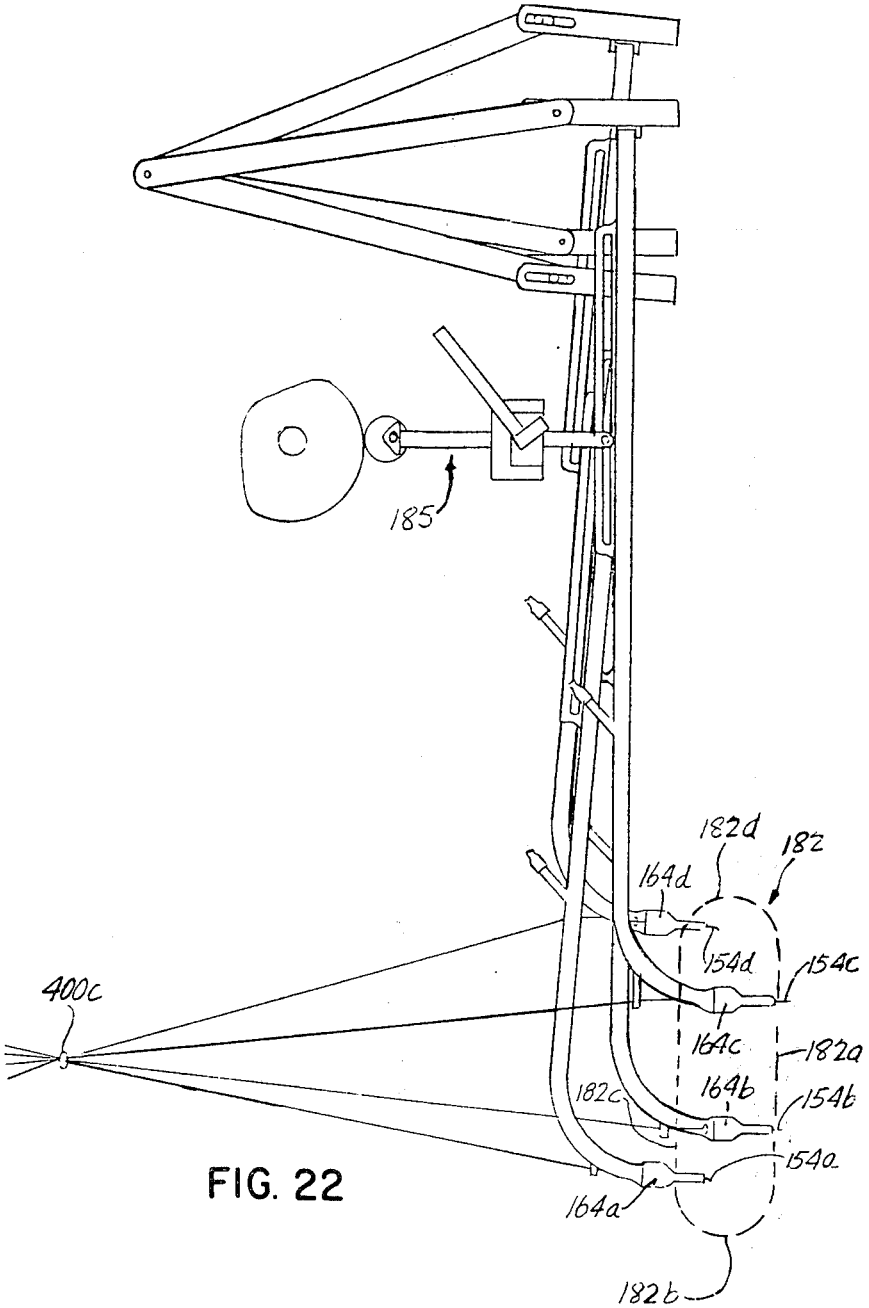
Figure 28:
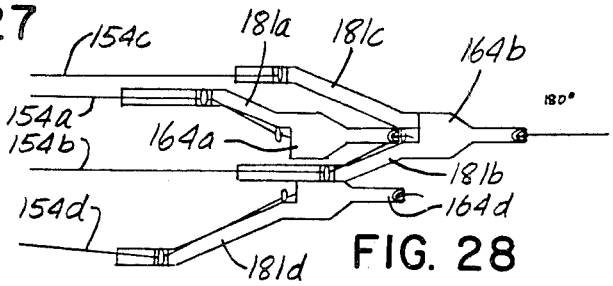

Referring now to FIGS. 22 and 28, the air jets 164b and 164c, which are still inserting the weft threads 154b and 154c, respectively, have moved further toward the fell along the leg 182a of the closed path 182. The air jets 164a and 164d are still positioned on the legs 182b and 182d, respectively, of the closed path 182. Although the elevation of the air jet 164b has not changed, the elevation of the air jet 164d has increased slightly (see FIG. 28).

Figure 29:
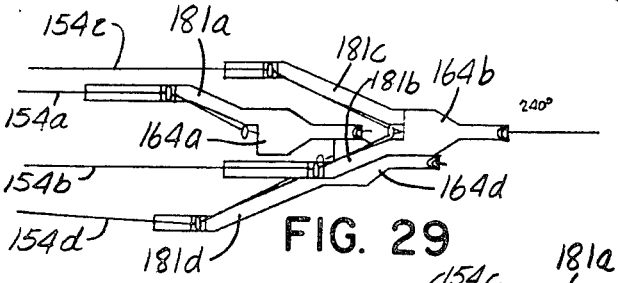

As shown in FIGS. 23 and 29, the weft thread 154b has been completely inserted, and the air jet 164b is still operating to tension the weft thread 154b. Also, air jet 164c is still inserting weft thread 154c. Further, both air jets 164b and 164c have moved further toward the fell along the leg 182a and the closed path 182. Although the air jet 164d is still moving upwardly along the leg 182d of the closed path 182, the air jet 164a has just begun to move from the leg 182b of the closed path 182 to the leg 182c of the closed path 182 without changing its elevation (see FIG. 29).

Figure 30:
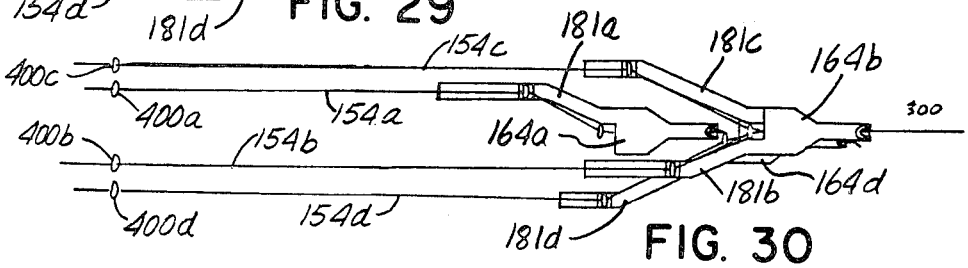
Figure 34:
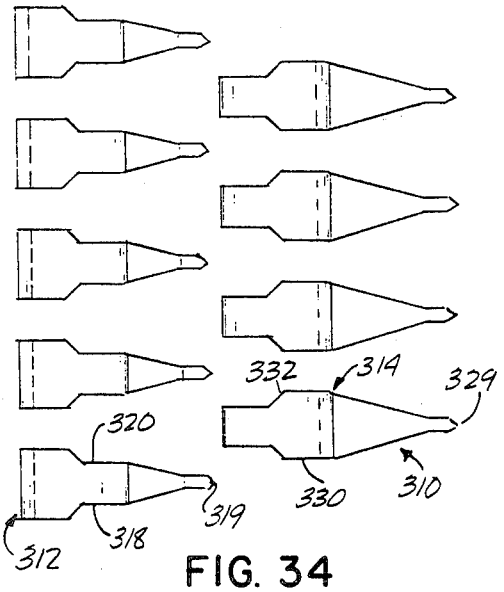
FIG. 34 is a schematic plan view of two sets of shed-retaining members constructed in accordance with yet another embodiment of the present invention, the shed-retaining members being positioned in an open or shed-releasing position.
Figure 36:
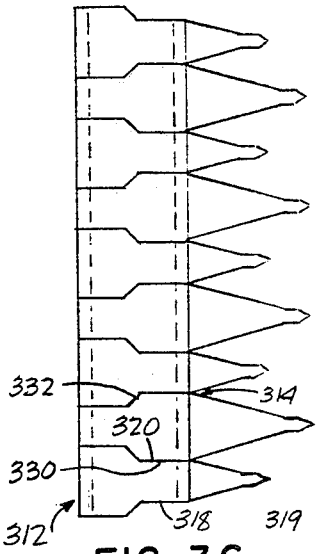
FIG. 36 is a schematic plan view of the shed-retaining members of FIG. 34, the shed-retaining members being positioned in a closed or shed-retaining position.
Figure 35:
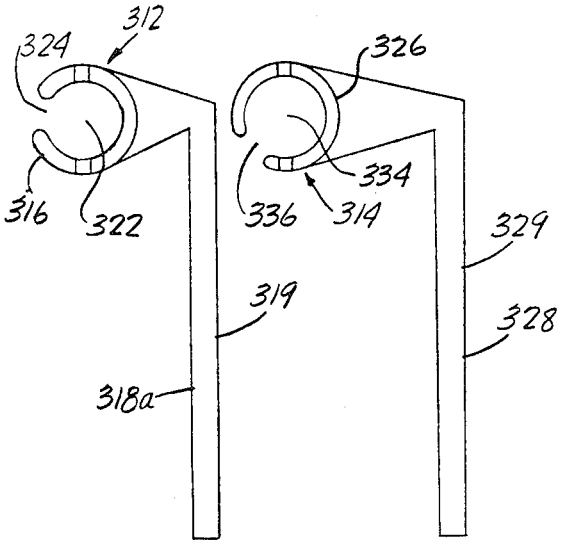
FIG. 35 is a schematic side elevational view of the shed-retaining members shown in FIG. 34.
Figure 37:
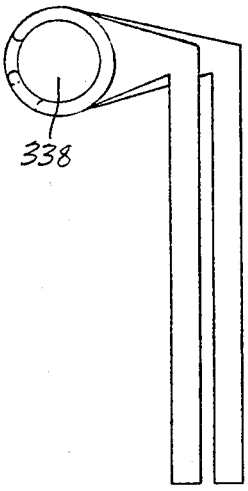
FIG. 37 is a schematic side elevational view of the shed-retaining member shown in FIG. 36.

Referring to FIGS. 24 and 30 (FIG. 30 being the view illustrated by the arrows 30—30 in FIG. 18), the air jet 164b has stopped and air jet 164c is still in the process of inserting the weft thread 154c. Both air jets 164b and 164c have moved further toward the fell along the leg 182a of the closed path 182. The air jet 164d continues its upward movement along the leg 182d of the closed path 182 toward the leg 182a of the closed path 182. When the air jet 164d reaches the leg 182a, the air jet 164d will be at the same elevation as the air jets 164a, 164b and 164c. The air jet 164a is now moving away from the fell along the leg 182c of the closed path 182.

The air jets 164a and 164b will travel around the closed path 182 without changing their elevation. The air jet 164c travels at the same elevation as the air jets 164a, 164b and 164d during their movement along the leg 182a of the closed path 182. However, the elevation of the air jet 164c will be increased during its movement along the legs 182b, 182c and 182d of the closed path 182d, thereby preventing the air jet 164c from interfering with the movement of the air jets 164a, 164b and 164d as they travel around the closed path 182.

The control mechanisms for controlling the movement of the arms 164a, 164b, 164c, and 164d are similar to the control mechanisms disclosed in the applicant's U.S. Pat. No. 4,122,872. For instance, the vertical and horizontal movement of the air jets 164d and 164c is effected by a control assembly 185 designed substantially the same as the control assembly illustrated in FIG. 11 of the applicant's U.S. Pat. No. 4,122,872. It is noted here that the thread guide eyes 400a, 400b, 400c and 400d are aligned (stacked) in the direction illustrated in FIG. 19. There are also thread guide eyes (not numbered) carried by the air jets.

Referring to FIGS. 31–33, there is shown a further embodiment of the exemplary shed retainer embodiment of FIGS. 5–17. The various elements illustrated in FIGS. 31–33 which correspond to elements described above with respect to FIGS. 5–17 have been designated by corresponding reference numerals increased by 100. New elements are designated by odd numbered reference numerals. Unless otherwise stated, the embodiment of FIGS. 31–33 operates in the same manner as the embodiment of FIGS. 5–17.

In the embodiment of FIGS. 31–33, a shed retainer 210 is provided with means for providing an air jet relay system. More particularly, the shed retainer 210 includes a shed-retaining member 211 and a plurality of shed-retaining members 212, which are mounted for rotation on a carriage 236 by stems 216. The shed-retaining member 211 has a stem 213 for rotatably mounting the shed-retaining member 211 to the carriage 236. The stem 213 extends through the carriage 236 and includes a passageway 215. Compressed air is supplied to a continuous substantially closed channel 232 through the passageway 215. Grooves 217 in the lower interior surfaces of the shed-retaining members 212 cooperate with a groove 219 in the lower interior surface of the shed-retaining member 211 to guide the compressed air in a desired direction after its discharge from the passageway 215 into the channel 232. The flow of compressed air through the passageway 211 can be controlled by a valve 221 which includes a cylinder 223 adapted to slidably receive an end 225 of the stem 213 of the shed-retaining member 211. The compressed air is supplied to the interior of the cylinder 223 through a port 227. In the position shown in FIGS. 31–33, the passageway 215 does not communicate with the port 227, thereby prohibiting the flow of compressed air into and out of the passageway 215. Cam surfaces 229 engage followers 231 attached to the cylinder 223 and, at a predetermined time, urge the followers 231 and hence the cylinder 223 upward against the force of coil springs 233 until the passageway 211 communicates with the port 227 in the cylinder 225. When the port 227 communicates with the passageway 215, compressed air flowing through the port 227 can be supplied to the passageway 215 which in turn delivers the compressed air to the channel 232. The compressed air delivered to the channel 232 by the passageway 215 facilitates the insertion of a weft thread through the channel 232, especially if the channel 232 is relatively long. It is finally noted in this regard that additional air jet relay systems could be added directed in the opposite direction for use when a weft thread is inserted from the opposite end. Further, you could have separate weft inserting air jets on the opposite ends of the sheds for inserting threads from either end.

The shed-retaining member 211 is provided with an upper ridge 235 and a lower ridge 237 which perform the same functions as upper ridges 226 and lower ridges 228, respectively, formed on the shed-retaining members 212. Weft-advancing arms 238 are carried by the carriage 236. The shed-retaining member 211 is also provided with a slot which functions in the same manner as the slots provided in the shed-retaining members 212. When the shed-retainer embodiment of FIGS. 31–33 is utilized, it is possible to initially insert a weft thread into the channel 232 by any suitable means in addition to fluid jets. For instance, the mechanical insertion technique disclosed in U.S. Pat. No. 3,821,972 may be employed to initially insert a weft thread into the channel 232.

Another exemplary shed-retainer embodiment is illustrated schematically in FIGS. 34–37. A shed-retainer 310 constructed in accordance with this embodiment includes two sets of shed-retaining members 312, 314. Each of the shed-retaining members 312 includes a tubular section 316 which is carried by a stem 318a, having a pointed leading edge 319 for facilitating the insertion of the shed-retaining members 312 into a shed between a pair of adjacent warp threads. The insertion of the shed-retaining members 312 can be further facilitated by utilizing a separate spreader mechanism (not shown) including a spreading element associated with each of the shed-retaining members 312 for spreading apart the weft threads between which the shed-retaining members 312 are to be inserted. The tubular section 316 has a pair of opposite sides 318, 320 and a bore 322 which extends through the tubular section 316 between the sides 318, 320. The central longitudinal axis of the bore 322 is generally parallel to the longitudinal axis of the tubular section 316. The tubular section 316 also includes a slot 324 which communicates with the bore 322 and extends between the sides 318 and 320 in a direction which is generally parallel to the central longitudinal axis of the bore 322.

Each of the shed-retaining members 314 includes a tubular section 326 which is carried by a stem 328, having a pointed leading edge 329 for facilitating the insertion of the shed-retaining members 314 into a shed between a pair of adjacent warp threads. It can also be seen that the shed retaining members 312 and 314 also have tapered portions (not numbered) which facilitate their removal from the warp threads. The insertion of the shed-retaining members 314 can be further facilitated by utilizing a separate spreader mechanism (not shown) including a spreading element associated with each of the shed-retaining members 314 for spreading apart the weft threads between which the shed-retaining members 314 are to be inserted. The tubular section 326 includes a pair of opposite sides 330, 332 and a bore 334 which extends through the tubular section 326 between the sides 330, 332. The central longitudinal axis of the bore 334 is generally parallel to the longitudinal axis of the tubular section 326. The tubular section 326 also includes a slot 336 which communicates with the bore 334 and extends between the sides 330, 332 in a direction which is generally parallel to the central longitudinal axis of the bore 334.

The shed-retaining members 312 are mounted for pivotal movement relative to the shed-retaining members 314 in a manner to be described hereinafter. In one position, i.e., a warp thread disengaging position, the shed-retaining members 312 are spaced from the shed-retaining members 314. In another position, i.e., a warp thread engaging position, the side 330 of the tubular section 326 of each of the shed-retaining members 314 is adapted to abut a side 320 of the tubular section 316 of an adjacent one of the shed-retaining members 312, while the side 332 of the tubular section 326 of each of the shed-retaining members 314 is adapted to abut the side 318 of the tubular section 316 of an adjacent one of the shed-retaining members 312. The sides 318 of the tubular sections 316 of the shed-retaining members 312 and the sides 332 of the tubular sections 326 of the shed-retaining members 314 have complementary shapes, while the sides 320 of the tubular sections 316 of the shed-retaining members 312 and the sides 330 of the tubular sections 326 of the shed-retaining members 314 have complementary shapes. Thus, when the shed-retaining members 312, 414 are in their warp thread engaging positions, the shed-retainer 310 assumes a shed-retaining position in which the bores 322 cooperate with the bores 334 to form a continuous substantially closed channel 338. When the shed-retainer 310 is in its shed-retaining position, the slots 324 are misaligned with the slots 336 so as to prevent the inadvertent removal of a weft thread (not shown) during its insertion through the channel 338.

Figure 39:
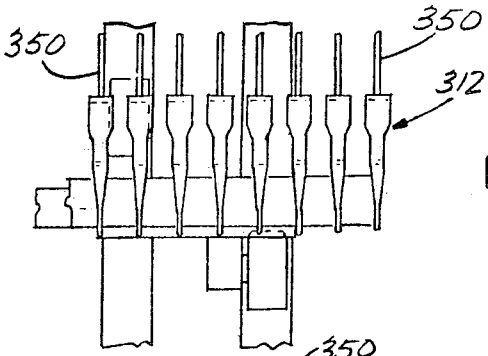
FIG. 39 is a partial plan view of a flat warp-wave weaving system showing only the shed-retaining members illustrated in FIG. 38.
Figure 40:
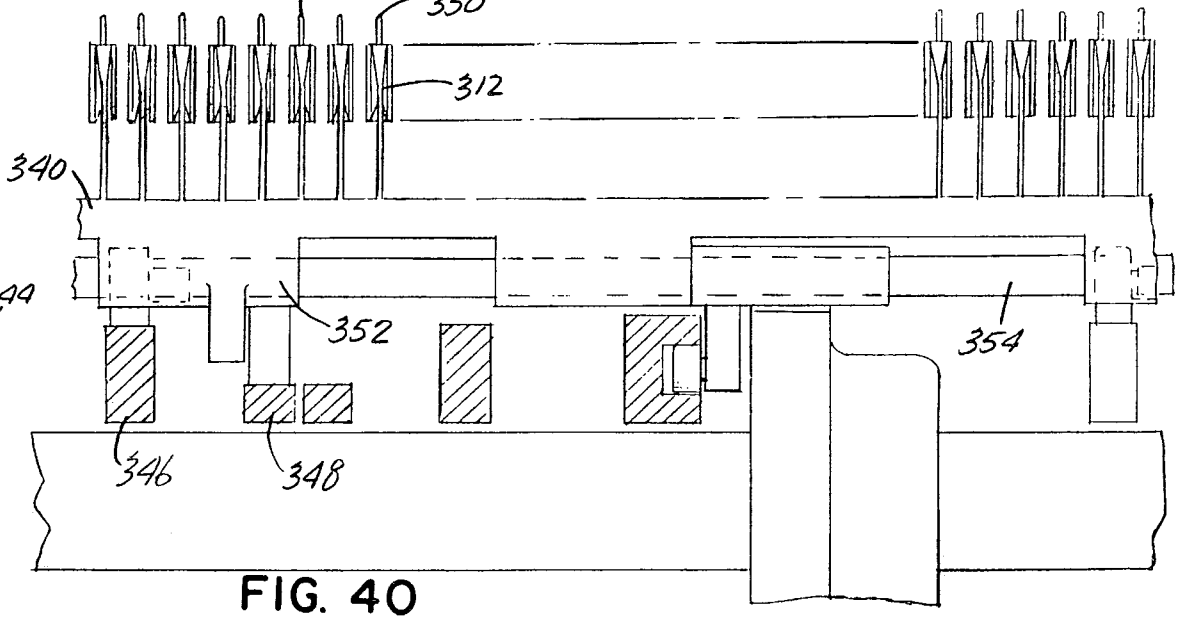
FIG. 40 is a front elevational view, partly in cross-section, of the flat warp-wave weaving system shown in FIG. 39.
Figure 38:
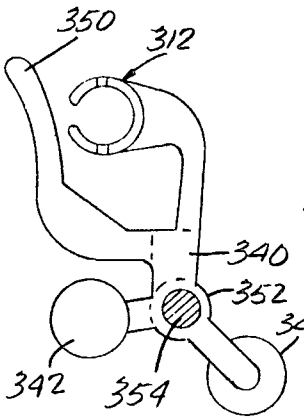
FIG. 38 is a side elevational view of one set of the shed-retaining members shown sehematically in FIGS. 34–37.

One technique for achieving the relative pivotal movement of the shed-retaining members 312, 314 is illustrated in FIGS. 38–43. As shown in FIGS. 38–40, the shed-retaining members 312 are carried by a carriage 340 which includes followers 342, 344 adapted to engage and roll along cam surfaces 346, 348, respectively, and a plurality of weft-advancing arms 350, each of which is associated with a corresponding one of the shed-retaining members 312. The weft-advancing arms 350 operate in the same manner as the weft-advancing arms utilized by the shed-retaining members shown in FIGS. 12–17. The followers 342, 344 are attached to bearings 352 which are designed for pivotal movement about an axle 354. The pivotal movement of the bearings 352 about the axle 354, which results in the pivotal movement of the shed-retaining members 312, is effected by the cam surfaces 346, 348, which are designed to change the position of the followers 342, 344 relative to the axle 354 in accordance with a predetermined pattern.

Figure 42:
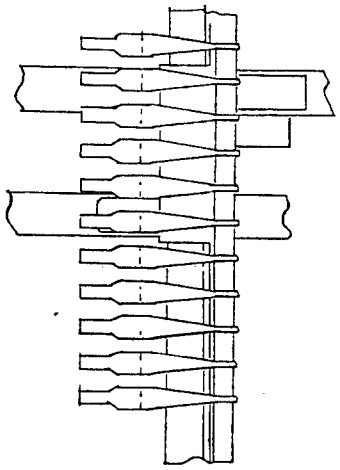
FIG. 42 is a partial plan view of a flat warp-wave weaving system utilizing the shed-retaining members illustrated in FIG. 41.
Figure 43:
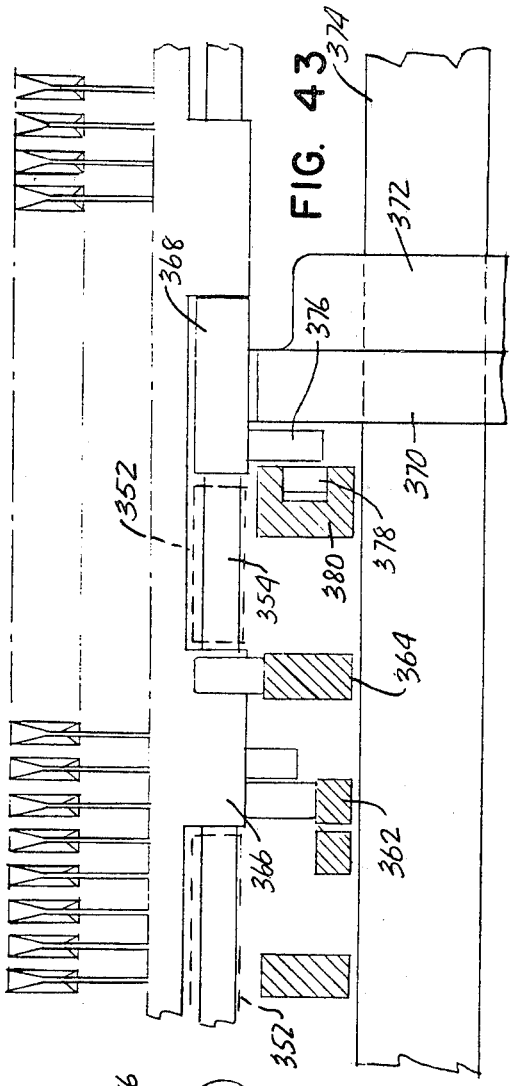
FIG. 43 is a front elevational view, partly in cross-section of the flat warp-wave weaving system shown in FIG. 42.
Figure 41:
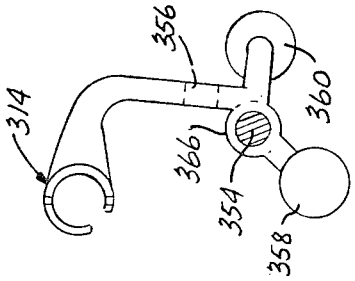
FIG. 41 is a side elevational view of the other set of the shed-retaining members shown schematically in FIGS. 34–37.
Figure 44:
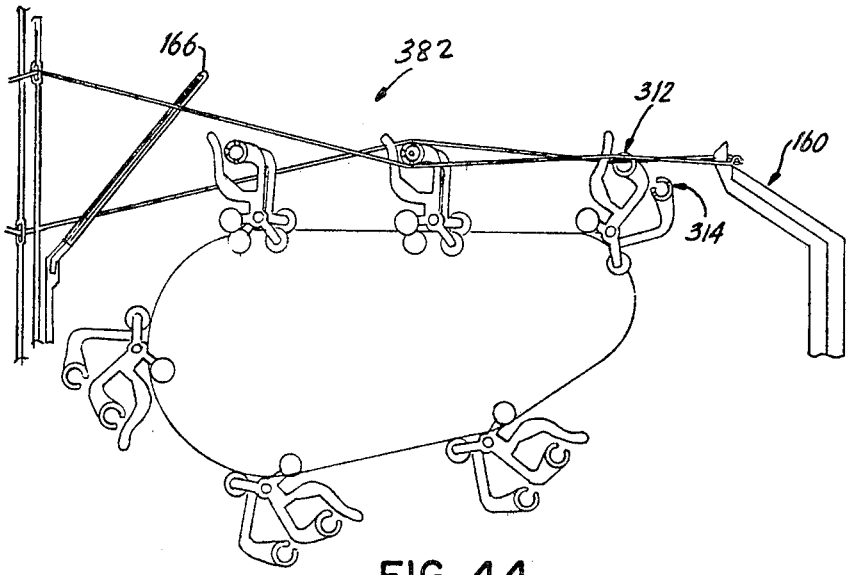
FIGS. 44–49 are side elevational views showing the successive steps in the operation of a flat warp-wave weaving system constructed in accordance with the present invention and employing the shed-retaining members of FIGS. 34–43.
Figure 45:
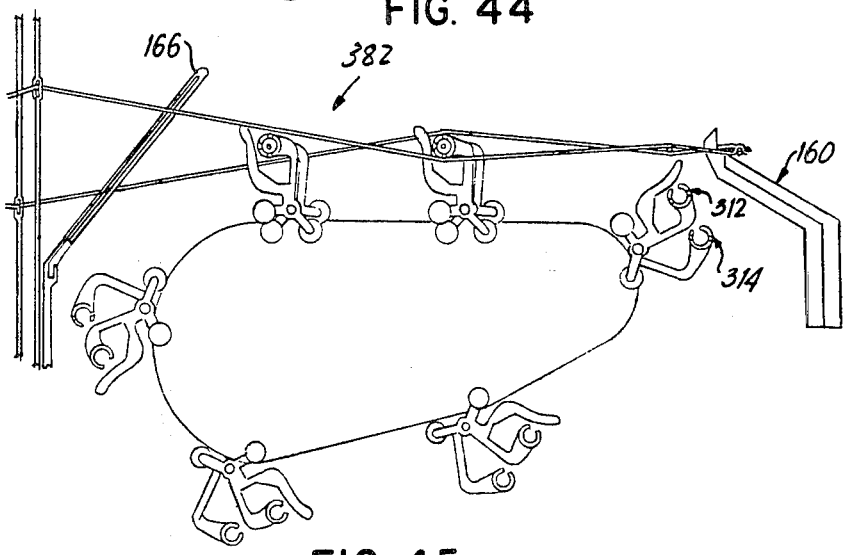
Figure 46:
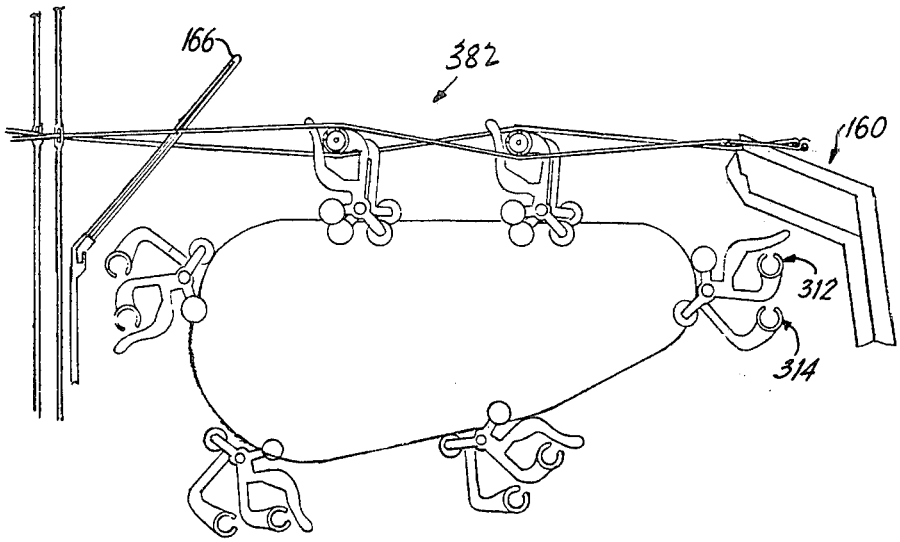
Figure 47:
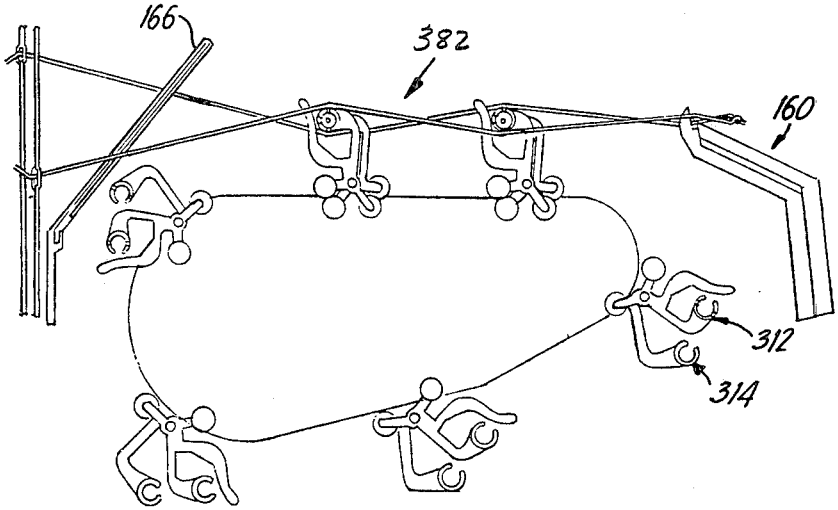
Figure 48:
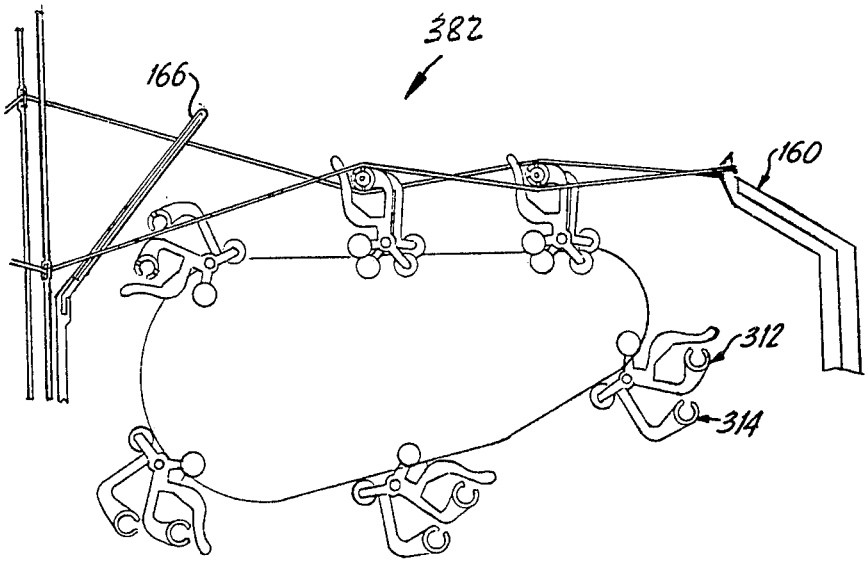
Figure 49:
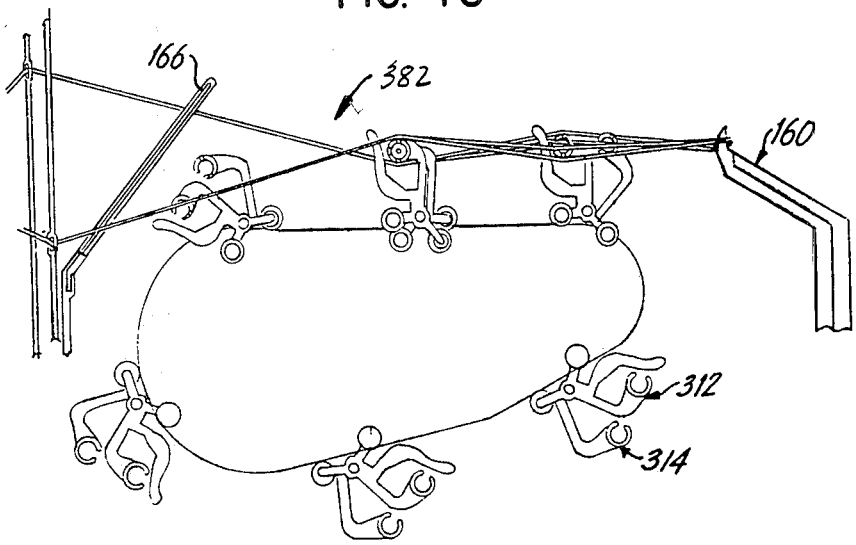

Referring to FIGS. 41–43, the shed-retaining members 314 are carried by a carriage 356 which includes followers 358, 360 adapted to engage and roll along cam surfaces 362, 364, respectively. The followers 358, 360 are attached to bearings 366 which are designed for pivotal movement about the axle 354. The pivotal movement of the bearings 366 about the axle 354, which results in the pivotal movement of the shed-retaining members 314, is effected by the cam surfaces 362, 364, respectively, which are designed to change the position of the followers 358, 360 relative to the axle 354 in accordance with a predetermined pattern. The location of the bearings 352 relative to the bearings 366 are illustrated by dotted lines.

One possible drive system for this retainer embodiment is illustrated in FIGS. 40 and 43. As shown therein, this drive system includes a sleeve 368 disposed about the axle 354 between one of the bearings 352 and an adjacent one of the bearings 366 (see, in particular, FIG. 43). An endless belt 370 is fixedly attached to the sleeve 368. The belt 370 is driven in a predetermined rotational direction by a sprocket wheel (not shown) housed in a casing 372 and rotated by a drive shaft 374. A support 376 depends from the sleeve 368 and carries a wheel 378, which is designed to ride in a track 380. The wheel 378 and the track 380 cooperate to support and guide the movement of the carriages 340, 356.

FIGS. 44–49 show progressive steps in the operation of a flat warp-wave weaving loom 382 employing the shed retainer embodiment of FIGS. 34–43. The operational steps shown in FIGS. 44–49 correspond to the operational steps disclosed in FIGS. 12–17, respectively. Accordingly, reference is made to the description of the operational steps disclosed in FIGS. 12–17 and the preceding description of the shed retainer embodiment of FIGS. 34–43 for an understanding of the operational steps illustrated in FIGS. 44–49. Additionally, a brief description of the operation is set forth hereinbelow highlighting those aspects which facilitate the introduction and removal of the shed-retaining members 312 and 314.

Withdrawal and introduction of the shed-retaining members 312 and 314 is achieved as they move arcuately and is facilitated by their tapered portions. During withdrawal, shed-retaining members 314 move ahead of shed-retaining members 312 in an arcuate path as determined by stationary cams 362 and 364. The upward arcuate movement of shed-retaining members 314 brings slots 336 level with the weft and warp threads and with slots 324. The retained weft thread can now exit slots 336. The arcuate path first swings tube sections 326 upward, then downward, bringing the tapered sections progressively to bear upon the warp threads, thus progressively spreading them apart to facilitate withdrawal of members 314. The warp threads released by the motion of members 314 trap the weft thread and cause it to exit through slots 324 and to contact weft advance arms 350. Shed-retaining members 312 now follow the same arcuate path which was earlier taken by shed-retaining members 314, and the warp threads are progressively spread apart in the same way by their tapered sections.

Introduction of the shed-retaining members 312 and 314 is accomplished with shed-retaining members 312 leading shed-retaining members 314. This is accomplished by cam surfaces 346, 348, 362 and 364 with the result that leading edges 319 first spread the warp threads and then the tapered portions of shed-retaining members 312 facilitate their movement between the warp threads. The leading edges 329 spread the warp threads and then the tapered portions of shed-retaining members 314 facilitate their movement between the warp threads.

The present apparatus may employ measuring devices for providing pre-measured lengths of thread to be inserted into the shed-retaining members. A suitable device for measuring and storing lengths of thread is taught in U.S. Pat. No. 3,926,224.

It will be understood that the embodiments described herein are merely exemplary and that a person skilled in the art may make many variations and modifications without departing from the spirit and scope of the invention. For instance, the number of sheds being retained at any one time can be varied, thereby increasing or decreasing the number of shed retainers and/or air jets which must be employed. Also, weft insertion can be initiated from both sides of a loom, rather than from just one side thereof. All such modifications and variations are intended to be included within the scope of the invention as defined in the appended claims.

I claim:

1. In a method of weaving including the steps of forming sheds of warp threads successively at a first location on a loom, continuously moving said sheds away from said first location and toward a second location spaced a distance from said first location such that said sheds move in a direction generally parallel to said warp threads, retaining a plurality of said sheds during the continuous movement of said sheds from said first location toward said second location, and inserting weft threads into said retained sheds during the continuous movement of said retained sheds from said first location toward said second location such that each of said retained sheds has a weft thread inserted thereinto; the improvement comprising the further steps of retaining said sheds by inserting shed-retaining means into each of said sheds, using said shed-retaining means to form a plurality of continuous substantially closed channels, each channel being formed in a corresponding one of said retained sheds, inserting said weft threads into said channels formed by said shed-retaining means using a plurality of fluid jets, each fluid jet being substantially constrained within a corresponding one of said channels by an associated shed-retaining means during the insertion of a respective weft thread and each weft thread being substantially constrained with a corresponding one of said channels by an associated shed-retaining means until its respective retained shed is released, moving said fluid jets alongside said retained sheds such that said fluid jets move in generally the same direction as said retained sheds during the insertion of said weft threads, and synchronizing the movement of said fluid jets with said retained sheds such that each fluid jet moves conjointly with a corresponding one of said retained sheds during the insertion of a respective weft thread, whereby a predetermined number of said weft threads can be inserted substantially simultaneously into a corresponding number of said retained sheds.

2. The improved method of claim 1, further comprising the steps of supplying said weft threads to said fluid jets from a plurality of stationary weft thread supply stations and moving said retained sheds in a substantially flat plane from said first location to said second location.

3. The improved method of claim 1 or 2, further comprising the step of imparting movement to said weft threads such that said weft threads move in generally the same direction as said retained sheds.

4. The improved method of claim 3, further comprising the step of synchronizing the movement of said weft threads with said fluid jets such that each weft thread moves conjointly with a corresponding one of said fluid jets.

5. The improved method of claim 1, further comprising the step of assisting each fluid jet by discharging at least one auxiliary fluid jet into a corresponding one of said channels at a point intermediate a pair of ends thereof.

6. The improved method of claim 1, further comprising the steps of releasing each of said retained sheds after the complete insertion of a respective weft thread thereinto.

7. The improved method of claim 1, further comprising the step of sustaining each of said fluid jets during the insertion of a corresponding one of said weft threads into a respective retained shed so as to ensure complete insertion of said corresponding one of said weft threads.

8. The improved method of claim 1, wherein said fluid jet means is an air jet.

9. In a weaving apparatus including shed forming means for forming sheds of warp threads successively at a first location on a loom, shed moving means for continuously moving said sheds away from said first location and toward a second location spaced a distance from said first location such that said sheds move in a direction generally parallel to said warp threads, shed retaining means for retaining a plurality of said sheds during the continuous movement of said sheds from said first location toward said second location, and inserting means for inserting weft threads into said retained sheds during the continuous movement of said retained sheds from said first location toward said second location such that each of said retained sheds has a weft thread inserted thereinto; the improvement wherein said retaining means retains said sheds by inserting shed-retaining members into each of said sheds such that said shed-retaining members form a plurality of continuous substantially closed channels, each channel being formed in a corresponding one of said retained sheds, and said inserting means includes a plurality of fluid jets arranged to insert said weft threads into said channels formed by said shed retaining means such that each fluid jet is substantially constrained within a corresponding one of said channels by associated shed-retaining members during the insertion of a respective weft thread and each weft thread is substantially constrained within a corresponding one of said channels by associated shed-retaining members until its respective retained shed is released, said improvement further comprising first imparting means for imparting movement to said fluid jets such that said fluid jets move alongside said retaining sheds and such that said fluid jets move in generally the same direction as said retained sheds during the insertion of said weft threads thereinto and first synchronizing means for synchronizing the movement of said fluid jets with said retained sheds such that each fluid jet moves conjointly with a corresponding one of said retained sheds during the insertion of a respective weft thread thereinto, whereby a predetermined number of said weft threads can be inserted substantially simultaneously into a corresponding number of said retained sheds.

10. The improved apparatus of claim 9, wherein said retained sheds move in a substantially flat plane from said first location to said second location and said first synchronizing means includes a plurality of movable arms, each of said arms carrying a corresponding one of said fluid jets.

11. The improved apparatus of claim 9, further comprising supplying means for supplying said weft threads to said fluid jets from a plurality of stationary weft thread supply stations.

12. The improved apparatus of claim 9 or 11, further comprising second imparting means for imparting movement to said weft threads such that said weft threads move in generally the same direction as said retained sheds.

13. The improved apparatus of claim 12, further comprising second synchronizing means for synchronizing the movement of said weft threads with said fluid jets such that each weft threads moves conjointly with a corresponding one of said fluid jets.

14. The improved apparatus of claim 13, wherein said first synchronizing means and said second synchronizing means include a plurality of movable arms and control means for controlling the movement of said arms such that said weft threads do not interfere with each other and said fluid jets do not interfere with each other.

15. In weaving apparatus including shed forming means for forming sheds of warp threads successively at a first location on a loom, shed moving means for continuously moving said sheds away from said first location and toward a second location spaced a distance from said first location such that said sheds move in a direction generally parallel to said warp threads, shed-retaining means for retaining a plurality of said sheds during the continuous movement of said sheds from said first location toward said second location, and inserting means for inserting weft threads into said retained sheds during the continuous movement of said retained sheds from said first location toward said second location such that each of said retained sheds has a weft thread inserted thereinto; the improvement wherein said weft thread inserting means includes a plurality of fluid jets and said shed-retaining means includes a plurality of independently operable groups of shed-retaining members, each group of shed-retaining members retaining a corresponding one of said sheds and each shed-retaining member being a split ring which is insertable between adjacent warp threads and into a corresponding one of said sheds defined, at least in part, by an elevated warp thread and a depressed warp thread, said split ring having an upper surface which, in a first position of said shed-retaining member, is engageable with said elevated warp thread and which, in a second position of said shed-retaining member, is disengageable from said elevated warp thread and a lower surface which, in said first position of said shed-retaining member, is engageable with said depressed warp thread and which, in said second position of said shed-retaining member, is disengageable from said depressed warp thread, said improvement further comprising first imparting means for imparting movement to said fluid jets such that said fluid jets move in generally the same direction as said retained sheds during the insertion of said weft threads thereinto, first synchronizing means for synchronizing the movement of said fluid jets with said retained sheds such that each fluid jet moves conjointly with a corresponding one of said retained sheds during the insertion of a respective weft thread thereinto, whereby a predetermined number of said weft threads can be inserted substantially simultaneously into a corresponding member of said retained sheds, and constraining means for constraining each fluid jet substantially within a corresponding one of said retained sheds, said constraining means including a plurality of continuous substantially closed channels, each channel passing through a corresponding one of said retained sheds and being formed in a corresponding one of said groups of shed-retaining members when each of said shed-retaining members thereof is in its said first position.

16. The improved apparatus of claim 15, wherein said corresponding one of said groups of shed-retaining members includes a first shed-retaining member and a second shed-retaining member, said first shed-retaining member cooperating with said second shed-retaining member to form a corresponding one of said channels when said first shed-retaining member is in its said first position and said second shed-retaining member is in its said first position.

17. The improved apparatus of claim 16, wherein said corresponding one of said groups of said shed-retaining members includes positioning means for simultaneously positioning said first and second shed-retaining members in their said first positions and for simultaneously positioning said first and second shed-retaining members in their said second positions.

18. The improved apparatus of claim 17, wherein said positioning means positions said first and second shed-retaining members generally transversely of said warp threads when said first and second shed-retaining members are in their said first positions and said positioning means positions said first and second shed-retaining members generally parallel to said warp threads when said first and second shed-retaining members are in their said second positions.

19. The improved apparatus of claim 18, wherein said positioning means includes rotating means for rotating said first and second shed-retaining members into and out of their said first and second positions.

20. The improved apparatus of claim 18, wherein said positioning means positions said first and second shed-retaining members such that said first and second shed-retaining members are in engagement with each other when they are in their said first positions and said first and second shed-retaining members are spaced apart when they are in their said second positions.

21. The improved apparatus of claim 16, wherein said first shed-retaining member has a first bore passing therethrough and said second shed-retaining member has a second bore passing therethrough, said first and second bores cooperating with each other to form a corresponding one of said channels when said first and second shed-retaining members are in their said first positions.

22. The improved apparatus of claim 21, wherein said first shed-retaining member includes a first slot extending from an outer surface of said first shed-retaining member to said first bore and said second shed-retaining member includes a second slot extending from an outer surface of said second shed-retaining member to said second bore, said first and second slots being in alignment with each other so as to permit the removal of a respective weft thread from said corresponding one of said groups of shed-retaining members when said first and second shed-retaining members are in their said second positions and said first and second slots being out of alignment with each other to inhibit the inadvertent removal of said respective weft thread from said corresponding one of said groups of shed-retaining members when said first and second shed-retaining members are in their said first positions.

23. The improved apparatus of claim 22, wherein said first and second slots are located such that said respective weft thread is simultaneously removed from said first and second slots when said first and second shed-retaining members are in their said second positions.

24. The improved apparatus of claim 16, wherein said corresponding one of said groups of said shed-retaining members includes positioning means for alternately positioning said first and second shed-retaining members in their said first positions and for alternately positioning said first and second shed-retaining members in their said second positions.

25. The improved apparatus of claim 24, wherein said positioning means positions said first and second shed-retaining members generally parallel to said warp threads when said first and second shed-retaining members are in their said first and second positions.

26. The improved apparatus of claim 25, wherein said positioning means includes moving means for moving said first and second shed-retaining members relative to each other in a direction generally parallel to said warp threads in order to move said first and second shed-retaining members into and out of their said first and second positions.

27. The improved apparatus of claim 26, wherein said positioning means positions said first and second shed-retaining members such that said first and second shed-retaining members are in engagement with each other when they are in their said first positions and said first and second shed-retaining members are spaced apart when they are in their said second positions.

28. The improved apparatus of claim 27, wherein said first shed-retaining member has a first bore passing therethrough and said second shed-retaining member has a second bore passing therethrough, said first and second bores cooperating with each other to form a corresponding one of said channels when said first and second shed-retaining members are in their said first positions.

29. The improved apparatus of claim 28, wherein said first shed-retaining member includes a first slot extending from an outer surface of said first shed-retaining member to said first bore and said second shed-retaining member includes a second slot extending from an outer surface of said second shed-retaining member to said second bore, said first and second slots being located so as to permit the removal of a respective weft thread from said corresponding one of said groups of shed-retaining members when said first and second shed-retaining members are in their said second positions and said first and second slots being out of alignment with each other to inhibit the inadvertent removal of said respective weft thread from said corresponding one of said groups of shed-retaining members when said first and second shed-retaining members are in their said first positions.

30. The improved apparatus of claim 29, wherein said first and second slots are located such that said respective weft thread is alternately removed from said first and second slots when said first and second shed-retaining members in their said second positions.

31. The improved apparatus of claim 27, wherein said first shed-retaining member includes a first surface, having a first preselected shape, and said second shed-retaining member includes a second surface, having a second preselected shape which is generally complementary to said first preselected shape, said first surface of said first shed-retaining member engaging said second surface of said second shed-retaining member when said first and second shed-retaining members are in their said first positions.

32. The improved apparatus of claim 31, wherein each of said first and second shed-retaining members includes a first portion, having a first preselected thickness, and a second portion, having a second preselected thickness which is greater than said first preselected thickness, said first and second portions of said first shed-retaining member cooperating to define said first surface of said first shed-retaining member and said first and second portions of said second shed-retaining member cooperating to define said second surface of said second shed-retaining member, whereby said first portion of said first shed-retaining member engages said second portion of said second shed-retaining member when said first and second shed-retaining members are in their said first positions and said second portion of said first shed-retaining member engages said first portion of said second shed-retaining member when said first and second shed-retaining members are in their said first positions.

33. The improved apparatus of claim 15, wherein said split ring includes first engaging means for releasably engaging said elevated warp thread and second engaging means for releasably engaging said depressed warp thread.

34. The improved apparatus of claim 33, wherein said first engaging means is a first ridge extending generally transversely across an upper surface of said split ring and said second engaging means is a second ridge extending generally transversely across a lower surface of said split ring.

35. The improved apparatus of claim 15, wherein at least one of said shed-retaining members of said corresponding one of said groups of shed-retaining members includes discharging means for discharging an auxiliary fluid jet into said corresponding one of said channels.

36. The improved apparatus of claim 9, wherein said fluid jet means is an air jet.

37. In a shed-retaining member for use in connection with the loom weaving of warp and weft threads into cloth of the type wherein said loom has shed-forming means for elevating some of said warp threads and depressing other of said warp threads in accordance with a predetermined pattern, said shed-retaining member being readily insertable between adjacent warp threads and into a shed defined by said elevated warp threads and said depressed warp threads and having an upper surface which, in a first position of said shed-retaining member, is engageable with an elevated warp thread and a lower surface which, in said first position of said shed-retaining member, is engageable with a depressed warp thread, said upper surface being disengageable from said elevated warp thread when said shed-retaining member is in a second position and said lower surface being disengageable from said depressed warp thread when said shed-retaining member is in a second position, the improvement wherein said shed-retaining member is a split ring which includes a bore extending axially therethrough so as to receive a weft thread inserted through said shed-retaining member when said shed-retaining member is in its said first position and a slot extending from an outer surface of said split ring to said bore so as to permit the removal of said weft thread from said bore when said shed-retaining member is in its said second position.

38. The improved shed-retaining member of claim 37, wherein said split ring includes first engaging means for releasably engaging said elevated warp thread and second engaging means for releasably engaging said depressed warp thread.

39. The improved shed-retaining member of claim 38, wherein said first engaging means is a first ridge extending generally transversely across an upper surface of sad split ring and said second engaging means is a second ridge extending generally transversely across a lower surface of said split ring.

40. The improved shed-retaining member of claim 37, further comprising positioning means for positioning said shed-retaining member generally parallel to said warp threads when said shed-retaining member is in its said second position and for positioning said shed-retaining member generally transverse of said warp threads when said shed-retaining member is in its said first position.

41. The improved shed-retaining member of claim 40, wherein said positioning means includes rotating means for rotating said shed-retaining member into and out of its said first and second positions.

42. The improved shed-retaining member of claim 40, wherein said bore is located so as to form a portion of a continuous substantially closed channel when said shed-retaining member is in its said first position.

43. The improved shed-retaining member of claim 42, wherein said slot is located so as to form a portion of a substantially straight slot when said shed-retaining member is in its said second position.

44. The improved shed-retaining member of claim 42, further comprising discharging means for discharging an auxiliary fluid jet into said channel.

45. A method of retaining a shed formed from a plurality of warp threads by elevating some of said warp threads by elevating some of said warp threads and depressing other of said warp threads in accordance with a predetermined pattern to form a shed between said elevated warp threads and said depressed warp threads, comprising the steps of providing first and second guide-forming members, each of said first and second guide-forming members including a bore passing therethrough and said first and second guide-forming members being movable between a first position in which said first and second guide-forming members are arranged generally parallel to said warp threads so that said first and second guide-forming members can be inserted into and withdrawn from said shed between adjacent warp threads and a second position in which said first and second guide-forming members are arranged generally transversely of said warp threads in direct engagement with each other so that said bores of said first and second guide-forming members cooperate with each other to form a continuous substantially closed weft thread guide located within said shed, and moving said first and second guide-forming members into direct engagement with said elevated and depressed warp threads when said first and second guide-forming members are in their said second positions, whereby said first and second guide-forming members function to maintain said elevated and depressed warp threads in elevated and depressed positions, respectively, to thereby retain said shed after its formation while simultaneously functioning as weft guides.

46. The method of claim 45, further comprising the step of moving said first and second guide-forming members out of engagement with said elevated and depressed warp threads when said first and second guide-forming members are in their said first positions, whereby said retained shed is released.

47. A method of retaining a shed formed from a plurality of warp threads by elevating some of said warp threads and depressing other of said warp threads in accordance with a predetermined pattern to form a shed between said elevated warp threads and said depressed warp threads, comprising the steps of providing first and second guide-forming members, each of said first and second guide-forming members including a bore passing therethrough; alternately inserting said first and second guide-forming members into said shed between adjacent warp threads; moving said first and second guide-forming members into direct engagement with each other after their insertion into said shed; aligning said bore of said first guide-forming member with said bore of said second guide-forming member, whereby said bores cooperate to form a continuous substantially closed channel capable of receiving a weft thread inserted through said shed generally transversely of said warp threads; moving said first and second guide-forming members into direct engagement with said elevated and depressed warp threads, whereby said first and second guide-forming members function to maintain said elevated and depressed warp threads in elevated and depressed positions, respectively, to thereby retain said shed after its formation while simultaneously functioning as weft guides.

48. The method of claim 47, wherein said first and second guide-forming members are moved into engagement with each other by moving said first and second guide-forming members relative to each other in a direction generally parallel to said warp threads until said first and second guide-forming members are located alongside each other.

49. The method of claim 47, further comprising the steps of moving said first and second guide-forming members out of engagement with each other and alternately removing said first and second guide-forming members from said shed between adjacent warp threads after said first and second guide-forming members are disengaged from each other.

50. The method of claim 49, wherein said first and second guide-forming members are moved out of engagement with each other by moving said first and second guide-forming members relative to each other in a direction generally parallel to said warp threads.

51. The method of claim 49, further comprising the step of alternately removing said weft thread from said first and second guide-forming members, said weft thread being removed from said first guide-forming member during the removal of said first guide-forming member from said shed and said weft thread being removed from said second guide-forming member during the removal of said second guide-forming member from said shed.

52. The method of claim 47, wherein said bore of said first guide-forming member is aligned with said bore of said second guide-forming member by moving said first and second guide-forming members relative to each other in a direction generally parallel to said warp threads until said first and second guide-forming members are located alongside each other.

53. A shed retainer for insertion into a shed formed from a plurality of warp threads by elevating some of said warp threads and depressing other of said warp threads in accordance with a predetermined pattern, comprising a first shed-retaining member and a second shed-retaining member, each of said first and second shed-retaining members having a bore passing therethrough; inserting means for alternately inserting said first and second shed-retaining members into said shed between adjacent warp threads; first moving means for moving said first and second shed-retaining members into engagement with each other after their insertion into said shed; aligning means for aligning said bore of said first shed-retaining member with said bore of said second shed-retaining member when said first and second shed-retaining members are in engagement with each other, whereby said bores cooperate with said first and second shed retaining members to form a continuous substantially closed channel capable of receiving a weft thread inserted through said shed generally transversely of said warp threads; and first removing means for alternately removing said first and second shed-retaining members from said shed between adjacent warp threads.

54. The shed retainer of claim 53, wherein said first moving means moves said first and second shed-retaining members relative to each other in a direction generally parallel to said warp threads until said first and second shed-retaining members are located alongside each other.

55. The shed retainer of claim 53, further comprising second moving means for moving said first and second shed-retaining members out of engagement with each other.

56. The shed retainer of claim 55, wherein said second moving means moves said first and second shed-retaining members out of engagement with each other by moving said first and second shed-retaining members relative to each other in a direction generally parallel to each other.

57. The shed retainer of claim 53, further comprising second removing means for alternately removing said weft thread from said first and second shed-retaining members, said weft thread being removed from said first shed-retaining member during the removal of said first shed-retaining member from said shed and said weft thread being removed from said second shed-retaining member during the removal of said second shed-retaining member from said shed.

58. The shed retainer of clam 53, wherein said aligning means aligns said bore of said first shed-retaining member with said bore of said second shed-retaining member by moving said first and second shed-retaining members relative to each other in a direction generally parallel to said warp threads until said first and second shed-retaining members are located alongside each other.

59. The shed retainer of claim 53, further comprising second moving means for moving said first and second shed-retaining members into engagement with said elevated and depressed warp threads when said first and second shed-retaining members are in engagement with each other, whereby said elevated and depressed warp threads are maintained in elevated and depressed positions, respectively, to retain said shed after its formation.

60. Apparatus for spreading apart warp threads forming an open shed of warp threads, comprising a stationary base, a generally U-shaped spreading element mounted on said base and positioned between a pair of adjacent warp threads, one leg of said spreading element being fixedly connected to said base while an opposite leg of said spreading element is movable generally transversely of said warp threads between a first position in which said opposite leg of said spreading element does not affect the spacing between said adjacent warp threads and a second position in which said opposite leg of said spreading element increases the spacing between said adjacent warp threads, and means for moving said opposite leg of said spreading element generally transversely of said warp threads between said first and second positions.

61. The improved shed-retaining member of claim 40, wherein said positioning means includes moving means for moving said shed-retaining member in a direction generally parallel to said warp threads in order to move said shed-retaining member into and out of its said first and second positions.

62. The method of claim 45, wherein said bore of each of said first and second guide-forming members is centrally located, whereby said weft thread guide is located in substantially the center of said shed.

63. The method of claim 47, wherein said bore of each of said first and second guide-forming members is centrally located, whereby said weft thread guide is located in substantially the center of said shed.

* * * * *